US011167193B2

(12) United States Patent
Christiansen et al.

(10) Patent No.: US 11,167,193 B2
(45) Date of Patent: Nov. 9, 2021

(54) GOLF SWING TRAINING APPARATUS

(71) Applicant: Black Diamond Creations, LLC, St. George, UT (US)

(72) Inventors: Brett D. Christiansen, St. George, UT (US); Christopher B. Christiansen, St. George, UT (US); James B. Christiansen, St. George, UT (US); Clancy B. Christiansen, St. George, UT (US); Bryce B. Christiansen, St. George, UT (US); Susan G. Christiansen, St. George, UT (US); Candice S. Christiansen, St. George, UT (US); Cathy Christiansen, St. George, UT (US); Kami Christiansen, St. George, UT (US); Phillip Dietz, St. George, UT (US)

(73) Assignee: Black Diamond Creations, LLC, St. George, UT (US)

( * ) Notice: Subject to any disclaimer, the term of this patent is extended or adjusted under 35 U.S.C. 154(b) by 0 days.

(21) Appl. No.: 17/101,123

(22) Filed: Nov. 23, 2020

(65) Prior Publication Data

US 2021/0154551 A1 May 27, 2021

Related U.S. Application Data

(60) Provisional application No. 62/949,214, filed on Dec. 17, 2019, provisional application No. 62/940,115, filed on Nov. 25, 2019.

(51) Int. Cl.
*A63B 69/36* (2006.01)
*A63B 15/00* (2006.01)

(52) U.S. Cl.
CPC ..... *A63B 69/3632* (2013.01); *A63B 15/00* (2013.01); *A63B 2220/40* (2013.01); *A63B 2220/833* (2013.01)

(58) Field of Classification Search
CPC ..... A63B 69/3632; A63B 15/00; A63B 2220/833; A63B 2220/40
USPC ..... 473/219, 234, 257, 409
See application file for complete search history.

(56) References Cited

U.S. PATENT DOCUMENTS 3,136,546 A * 6/1964 Connolly ..... A63B 24/0062 473/234
3,743,297 A * 7/1973 Dennis ..... A63B 15/00 473/242
3,759,527 A * 9/1973 Witherspoon ..... A63B 53/02 473/306
4,602,788 A * 7/1986 Wendt ..... A63B 15/00 473/242
5,593,155 A * 1/1997 Fauble ..... A63B 69/38 473/463

(Continued)

*Primary Examiner* — Nini F Legesse
(74) *Attorney, Agent, or Firm* — Gurr Brande & Spendlove, PLLC; Robert A. Gurr

(57) ABSTRACT

A golf swing training apparatus has a shaft, a housing with a top cap and a bottom cap, and a plurality of weighted discs receivable within the housing. A golfer may adjust the weight of the head of the club by adding or removing weighted discs in the housing. The golf swing training apparatus may comprise an accelerometer within the housing so as to measure the speed, acceleration, and swing path that the club takes for feedback and analysis to improve the golfers swing.

18 Claims, 24 Drawing Sheets

(56) References Cited

U.S. PATENT DOCUMENTS

| | | | | |
|---|---|---|---|---|
| 8,414,412 | B2 * | 4/2013 | Kim | A63B 69/3623 473/234 |
| 2004/0009826 | A1 * | 1/2004 | Aisenberg | A63B 15/00 473/256 |
| 2007/0155525 | A1 * | 7/2007 | Davenport | A63B 69/3623 473/256 |
| 2015/0087439 | A1 * | 3/2015 | Song | A63B 60/02 473/335 |

* cited by examiner

GOLF SWING TRAINING APPARATUS

CROSS-REFERENCE TO RELATED APPLICATIONS

This application claims the benefit of U.S. Provisional Application Ser. No. 62/940,115, filed on Nov. 25, 2019, and U.S. Provisional Application Ser. No. 62/949,214, filed on Dec. 17, 2019, both of which are incorporated herein by reference.

TECHNICAL FIELD

The present disclosure relates to a training golf club. More particularly, the present disclosure relates to a golf swing training apparatus utilizing multiple removably attachable weights and an optional accelerometer.

BACKGROUND

Golf has been around for hundreds of years and has been enjoyed by many people. The game of golf has gained popularity in recent years and has advanced rapidly with technological developments improving golf equipment, such as golf ball design and golf club material. What was once a rudimentary game, has become a game of in-depth analysis where everything can be measured and calculated to get the most out of a golfer and their equipment.

Not only has the technology changed, but the approach to playing golf more efficiently has changed. The mechanics involved in a golf swing are complex and require skilled execution to complete a successful shot. A lot of time and effort has been placed on development of the golf swing due to the fact that a more powerful swing will produce a longer shot, which can be directly attributed to the head speed of a club when it strikes the ball. When a ball travels farther down the fairway, it means that the subsequent shots will be shorter to the hole, thereby potentially decreasing the number of strokes.

There are other training clubs that exist that claim to increase a golfer's hitting distance, accuracy, flexibility, and strength. Some of these training clubs use a variety of weight components to try and increase club head speed. Even though these training clubs seek to improve a golfer's club speed, they have many shortcomings. Specifically, the training clubs are only available in multiple club options, requiring a user to switch clubs for differing weights. This adds significantly to the cost of purchasing training clubs.

Further, carrying three or more extra clubs in a golf bag is burdensome and may be impossible. A typical golfer usually only has 14 clubs in their bag. Golf bags on the market often do not have room for more, making it cumbersome to carry more. Being limited to a certain number of clubs decreases the likelihood of a golfer carrying an additional practice club. In addition, a family could not use a single set of training clubs, because the weight of women's and senior's training clubs are typically different, so they must purchase their own training clubs. Further, other training clubs come in a single weight for all golfers. These clubs are usually heavily weighted to stretch out a golfer's muscles. Without the ability to adjust the club, it limits who can use the club.

Increasing speed is one of the most important outcomes of using a training club. However, it is difficult to know if the training has been effective. For example, without purchasing a separate measurement device that will measure the speed of the head of the training club, it may be difficult for a golfer to know if the training club has improved their swing. These measurement devices are expensive and measure only the speed of the training club as it goes past the measurement device.

Accordingly, there is a need for a golf training club that eliminates the necessity of having multiple clubs, can have an adjustable weight system, and, ideally, has a measurement device that measures the speed, acceleration, and swing path of a complete swing. The present disclosure seeks to solve these and other problems.

SUMMARY OF EXAMPLE EMBODIMENTS

In one embodiment, a golf swing training apparatus (referred to herein as a "golf apparatus") comprises a shaft, a housing with a top cap and a bottom cap, and a plurality of removable weighted discs. The shaft comprises a top portion and a bottom portion, wherein the top portion includes a handle, and the bottom portion includes the housing with the top and bottom cap, and the plurality of removable weighted discs. The housing may comprise tiered disc protrusion channels and a housing shaft in the center thereof. The housing shaft may comprise a disc securement mechanism. The plurality of removable weighted discs may comprise a first disc, a second disc, a third disc, a fourth disc, etc.

In one embodiment, a golf apparatus comprises a shaft, a housing with a top cap and a bottom cap coupleable thereto, and a plurality of removable weighted discs. The top cap may comprise a first disc receiver and a second disc receiver so as to receive the removable weighted discs.

In one embodiment, a golf apparatus comprises a club cap.

In one embodiment, a golf apparatus comprises an accelerometer.

In one embodiment, a golf apparatus comprises a transmitter to transmit information to a receiving device, such as a smartphone.

DETAILED DESCRIPTION OF EXAMPLE EMBODIMENTS

Figure 1:
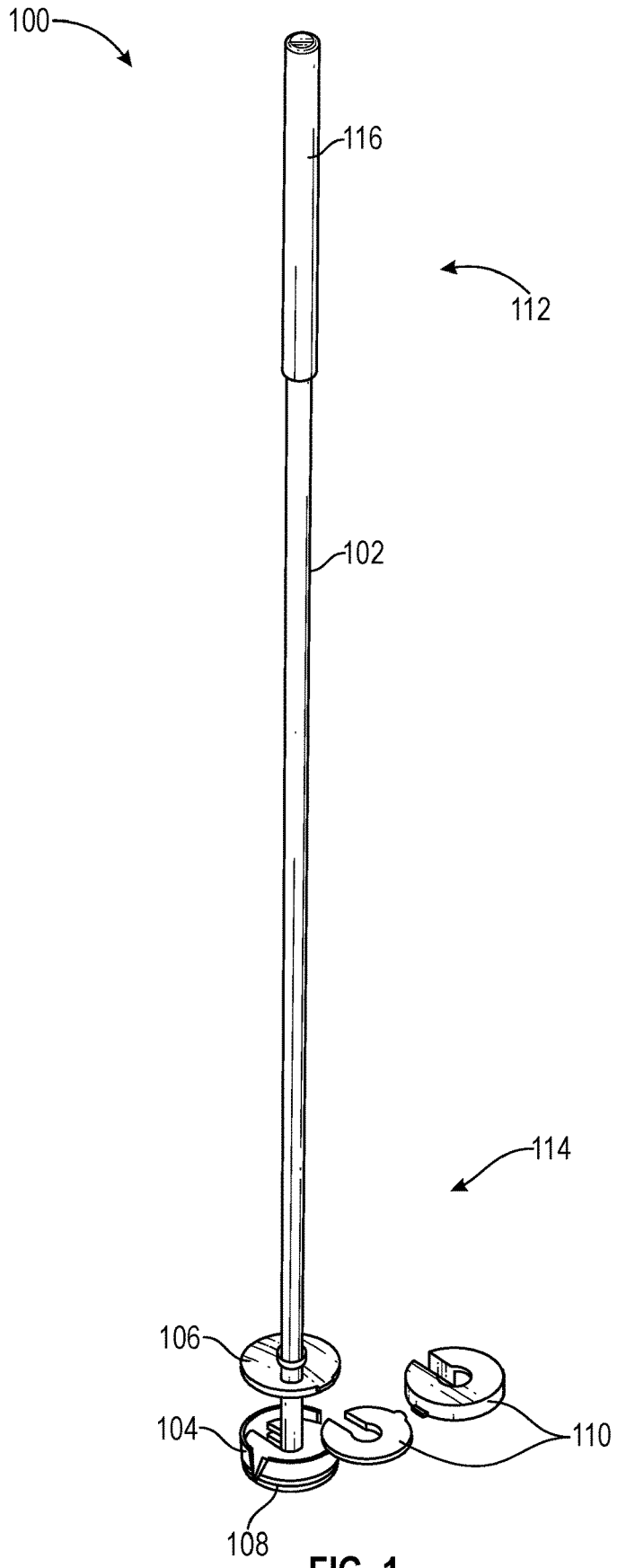
FIG. 1 illustrates a side, top perspective view of a golf swing training apparatus.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a golf training club that eliminates the necessity of having multiple clubs, can have an adjustable weight system, and that, ideally, has a measurement device that measures the speed, acceleration, and swing path of a complete swing. The golf swing training apparatus disclosed herein seeks to solve these and other problems.

A golf swing training apparatus (referred to herein as a "golf apparatus") allows a golfer to have a single training club that can adjust to all of their needs. The golf apparatus resembles a typical golf club by having a shaft with a handle. However, the golf club head on the golf apparatus varies from a typical golf club and a typical golf training club found in the prior art. Specifically, the golf apparatus club head may generally have a head that comprises a housing design to allow for weighted discs to be inserted and removed as needed, depending on the user's size, strength, and goals. The adjustable weight system allows the golfer to have one club for all training, instead of numerous clubs to address every training procedure. To use the golf apparatus, a golfer determines at what weight they want to train. Once the weight has been chosen, a golfer secures a top cap in the open position and either places or removes the weighted discs to achieve the desired training weight. Using a locking mechanism, which may use springs, or other locking mechanisms, the individual locks the top cap in place to prevent the weighed disks from moving or being ejected during a possible impact of the club head.

As shown in FIG. 1, in one embodiment, a golf apparatus 100 comprises a club shaft 102, a housing 104 with a top cap 106 and a bottom cap 108, and a plurality of removable weighted discs 110. The club shaft 102 comprises a top portion 112 and a bottom portion 114, wherein the top portion 112 includes a handle 116 and the bottom portion 114 includes the housing 104 with the bottom cap 108 and the top cap 106, and the plurality of removable weighted discs 110, which may be positioned in the housing 104.

The club shaft 102 may be of varying lengths, such as a short shaft for a child's club or a longer shaft for an adult golf club. The club shaft 102 may be stainless steel; however, other materials may be used, such as graphite, chrome-plated steel, titanium, carbon fiber, etc. The top portion 112 of the club shaft 102 comprises the handle 116, wherein the handle 116 may be a rubber, synthetic rubber, leather, or other material known in the art. Further, the bottom portion 114 of the club shaft 102 comprises the housing 104 with the top cap 106 and the bottom cap 108, and a plurality of removable weighted discs 110 that allow a user to adjust the weight of the golf apparatus 100 by simply adding or removing one or more discs 110 from the housing 104. While weighted discs 110 may be shown, it will be appreciated that other forms of adding weight in the housing 104 may be used, such as liquids, pellets, other weighted shapes, etc.

Figure 2:
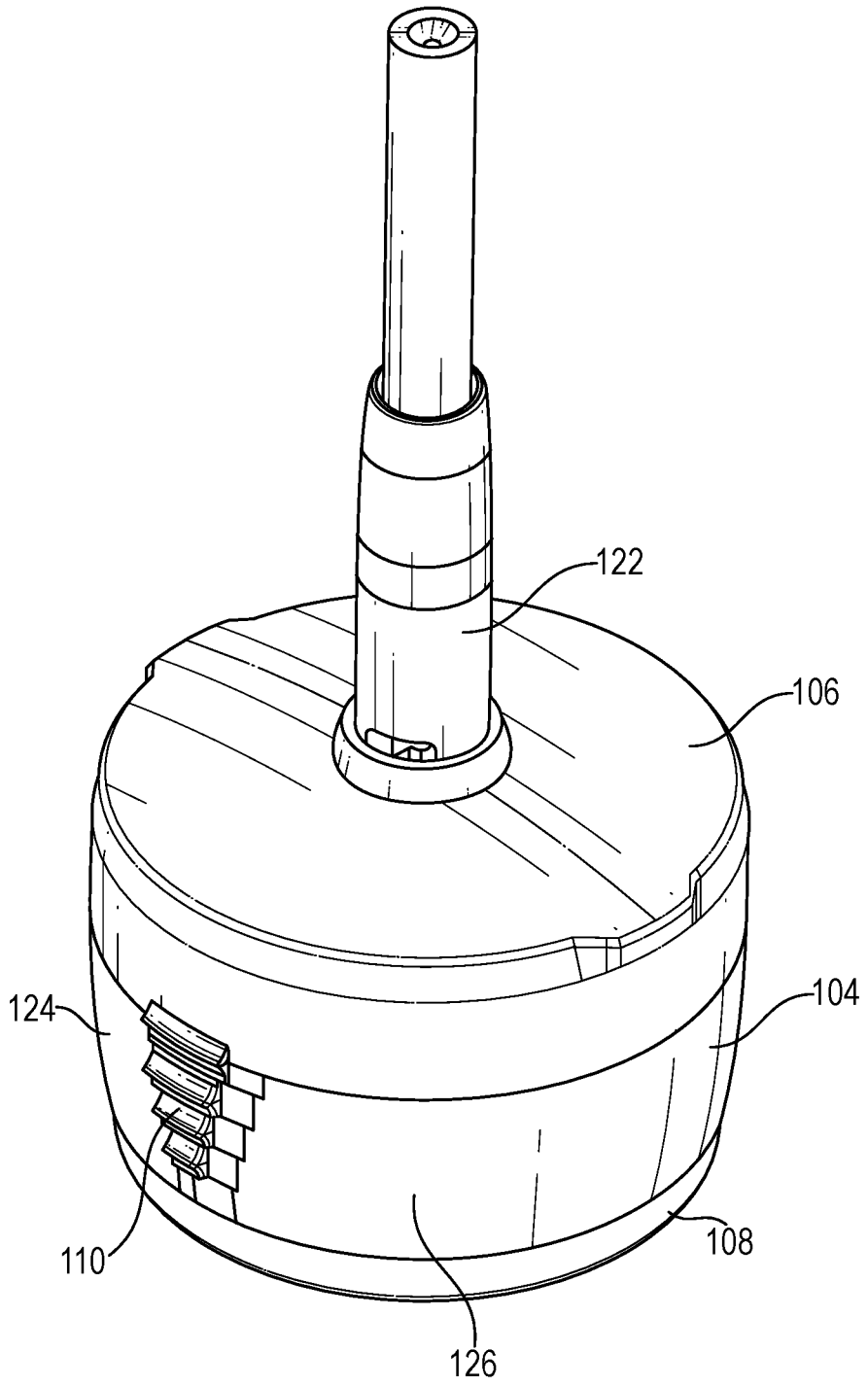
FIG. 2 illustrates a detailed, top perspective view of a housing of a golf swing training apparatus.
Figure 3:
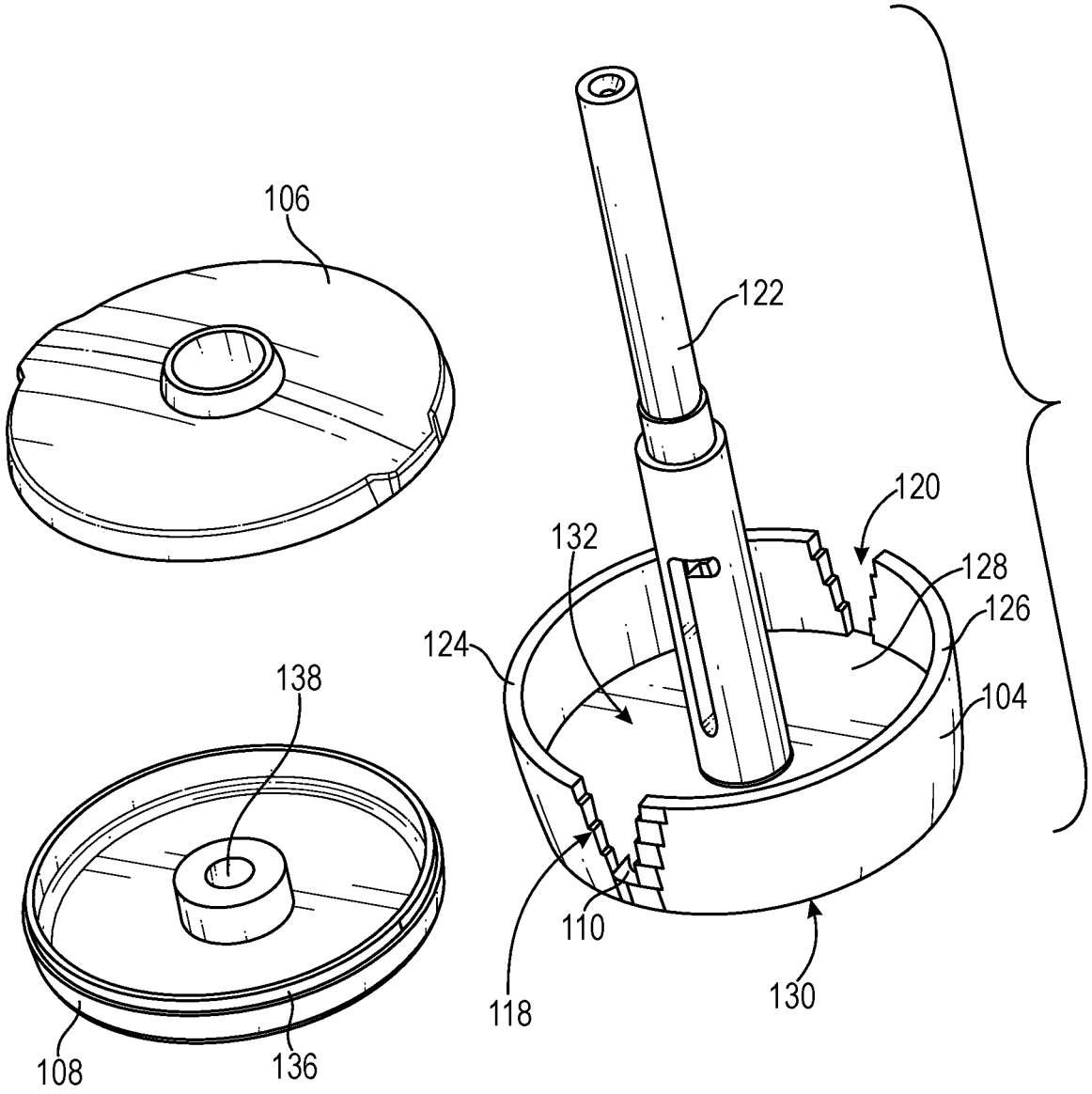
FIG. 3 illustrates a top, side perspective view of a housing with a top cap and a bottom cap of a golf swing training apparatus in a disassembled configuration.

As shown in FIGS. 2-3, the housing 104 may be cylindrical in shape, although other shapes or formfactors may also be used without departing herefrom. The housing 104 may be made of aluminum, plastic, carbon fiber, steel, combination of materials, etc. The housing 104 may further comprise a first tiered disc protrusion channel 118 and a second tiered disc protrusion channel 120 and a housing shaft 122 in the center thereof. To further contain the plurality of removable weighted discs 110 (such as discs 166, 168, 170, 172 shown in FIG. 4), the housing 104 may have a first wall 124, a second wall 126, and a base 128. The first and second walls 124, 126 may be separated by the first and second tiered disc protrusion channels 118, 120. The base 128 may comprise a lower surface 130 and an upper surface 132. The base 128 may have a first securement aperture 134 (shown in FIG. 5) in the center thereof. Further, the lower surface 130 may be recessed so as to receive the bottom cap 108. Accordingly, the bottom cap 108 may comprise a bottom cap lip 136 that is smaller in circumference than the lower surface 130 so that the bottom cap 108 may nest with the base 128.

Referring to FIGS. 4-8, the bottom cap 108 may have a second securement aperture 138. It will be understood that the first and second securement apertures 134, 138 receive a securement mechanism 140 (e.g., a screw). For example, the screw may be placed through the first and second apertures 134, 138 to secure the bottom cap 108 to the housing 104 to protect the housing 104 from unintentional contact with objects while swinging the golf apparatus 100. While the screw may be the desired securement mechanism 140, other securement mechanisms may be used, such as bolts and wingnuts, twist and lock, or the bottom cap 108 may be threaded and may screw into the lower surface of the base 128 via complementary threads in the base 128. Further, while the bottom cap 108 is a separate part of the housing 102, it will be appreciated that the bottom cap may be a permanent part of the housing 102, or that it may be omitted entirely.

The housing shaft 122 may be situated in the center of the housing 104, extending upwardly from the upper surface 132 of the base 128. The housing shaft 122 can be a tiered hollow shaft (cross-section shown in FIG. 7) that may couple to the club shaft 102 through various coupling means, such as a two-part epoxy that may be used and placed on the exterior of the housing shaft 122 to be inserted into the club shaft 102. The club shaft 102 may extend over the housing shaft 122 until it abuts neck 142. Additional methods of coupling the club shaft 102 to the housing shaft 122 may also be used, such as by using threads, twist and lock mechanisms, cotter pins, spring-loaded pins, etc.

The housing shaft 122 may comprise a disc securement mechanism, wherein the disc securement mechanism comprises a first shaft groove 144, a second shaft groove 146, a pin 148, a compression spring 150, and a spring set 151. The first and second shaft grooves 144, 146 may be inverted L-shaped grooves. The disc securement mechanism provides for adjustability and secures the plurality of removable weighted discs 110 (e.g., 166, 168, 170, 172). The disc securement mechanism may come in various sizes to accommodate for golfers of various ages and sizes.

Figure 4:
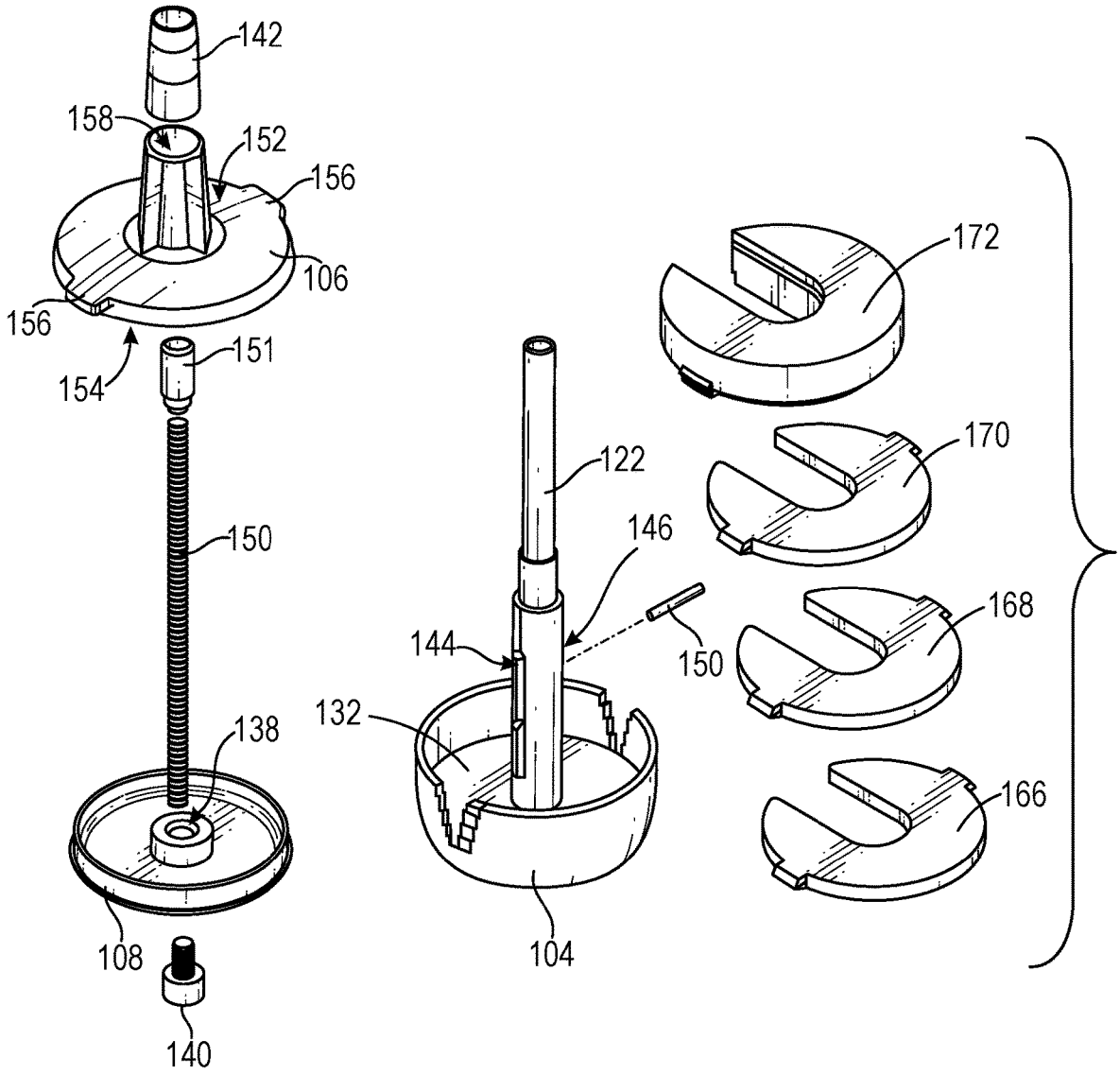
FIG. 4 illustrates an exploded view of a housing and a plurality of weighted discs of a golf swing training apparatus.
Figure 5:
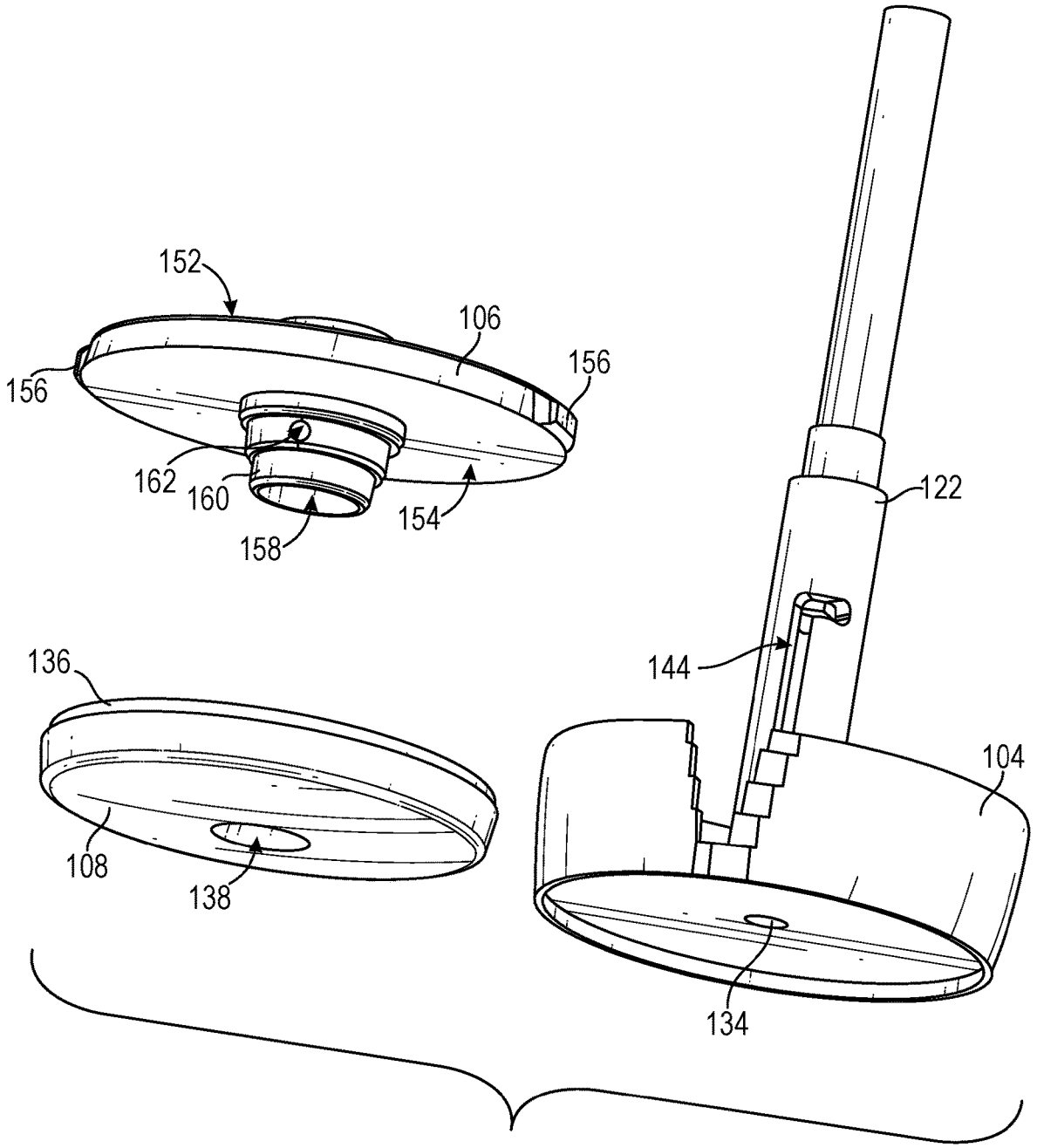
FIG. 5 illustrates a bottom, side perspective view of a housing with a top cap and a bottom cap of a golf swing training apparatus in a disassembled configuration.

Additionally, the top cap 106 aids in securing the plurality of removable weighted discs 110. As shown in FIGS. 4-5, the top cap 106 comprises a top surface 152, a bottom surface 154, and a pair of finger protrusions 156. The top surface 152 comprises a housing shaft aperture 158, that passes through to the bottom surface 154, for receiving the housing shaft 122 and interacting with the disc securement mechanism. The bottom surface 154 comprises a tiered protrusion 160 with a first pin aperture 162 and a second pin aperture 164.

Figure 6:
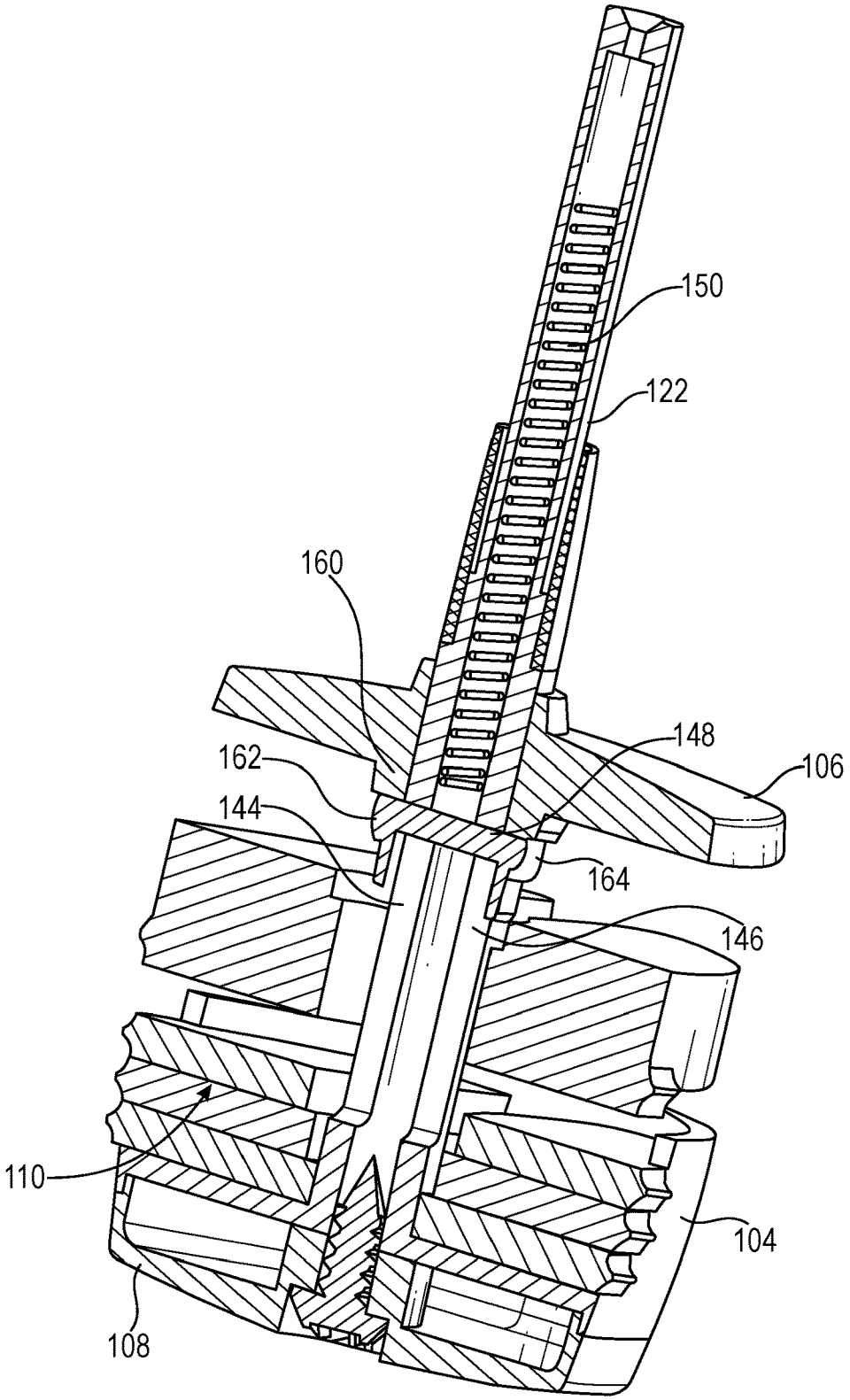
FIG. 6 illustrates a perspective, cross-sectional view of a housing of a golf swing training apparatus in an assembled configuration.
Figure 7:
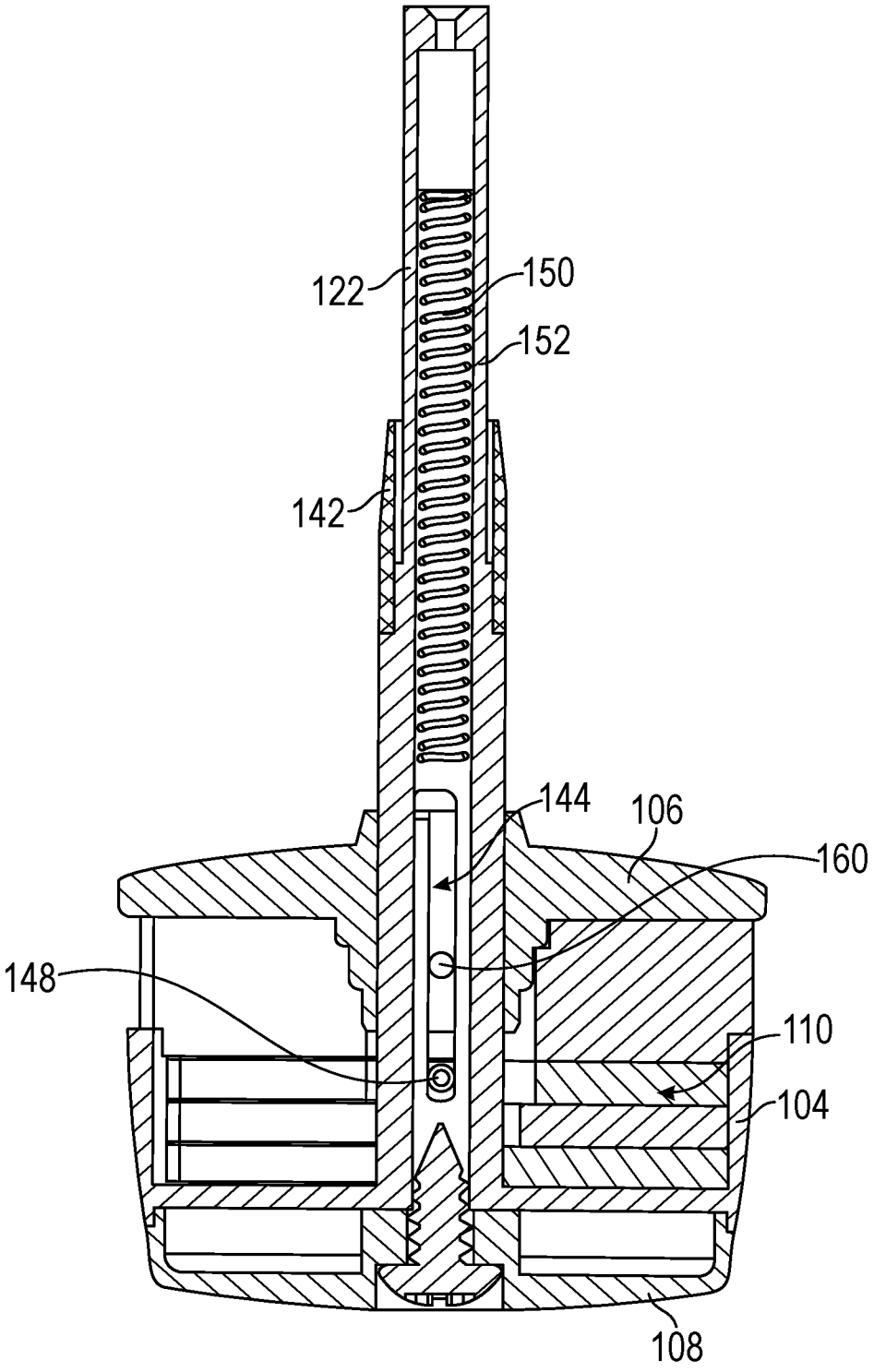
FIG. 7 illustrates a cross-sectional side elevation view of a housing of a golf swing training apparatus in an assembled configuration.

Referring to FIGS. 5-7, to establish a secured housing 104 that contains the plurality of removable weighted discs 110, the pin 148 passes through the first pin aperture 162 of the top cap 106, through the first housing shaft groove 144, under the inner spring 150, through the second housing shaft groove 146, and to the second pin aperture 164. The compression spring 150 is positioned within the housing shaft 122 and applies pressure to the pin 148. Further, the spring 150 may create torsion to rotate the top cap 106, securing it in either a clockwise or counterclockwise direction. To secure the top cap 106 in an open position, a golfer would grasp the pair of finger protrusions 156 and lift the top cap 106 by compressing the compression spring 150. Once the top cap 106 with the pin 148 has reached the top of the first and second shaft grooves 144, 146, which are inverted L-shaped grooves, the golfer turns (e.g., counterclockwise) the top cap 106 to secure it in an open position, the pin 148 prohibiting the spring from extending. It will be appreciated that many other securement mechanisms may be used to secure the top cap 106 and the plurality of removable weighted discs 110, such as a threaded top screw cap or snap and lock top cap.

Figure 8:
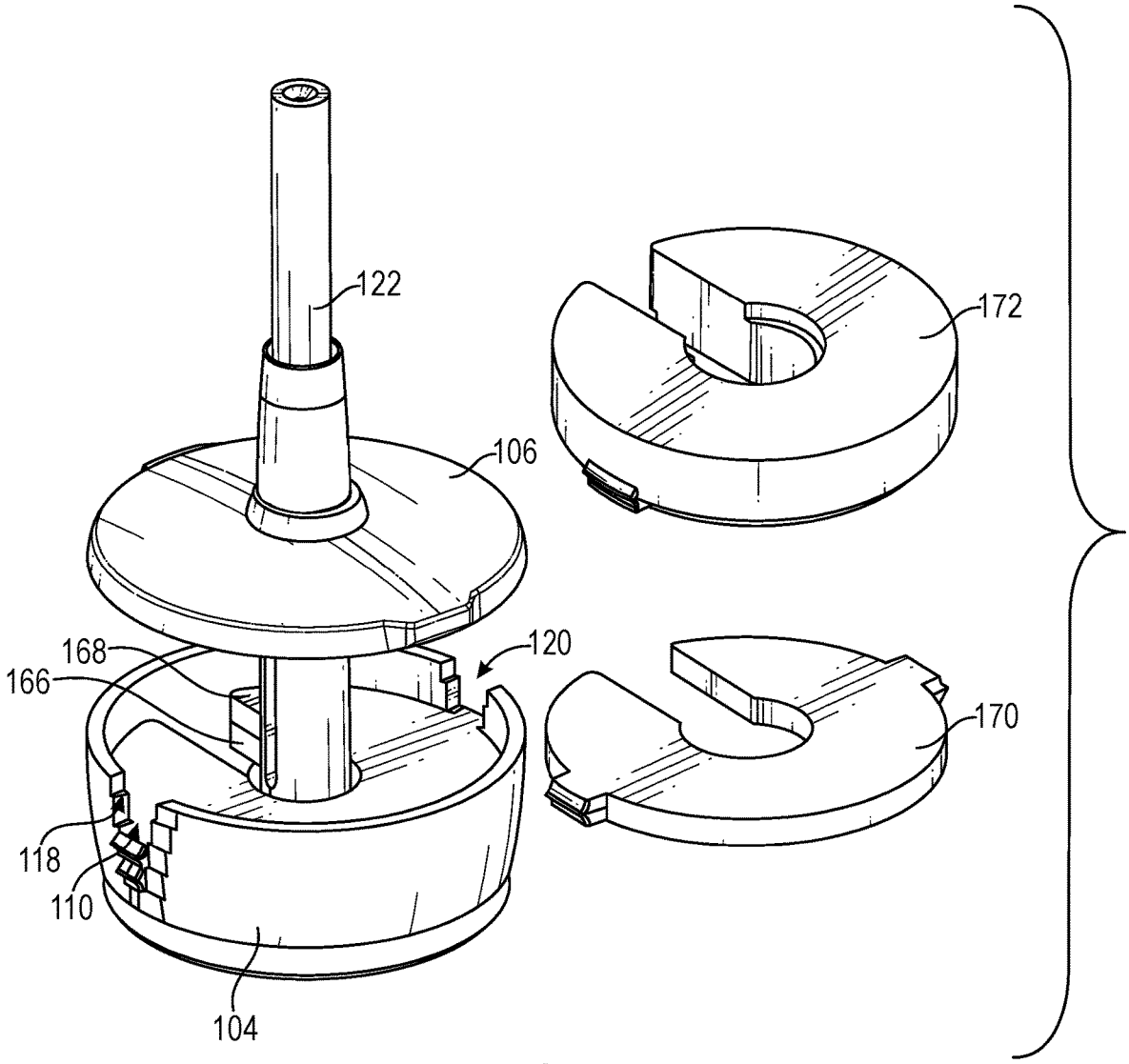
FIG. 8 illustrates a top perspective view of a housing and a plurality of removable weighted discs of a golf swing training apparatus.
Figure 9:
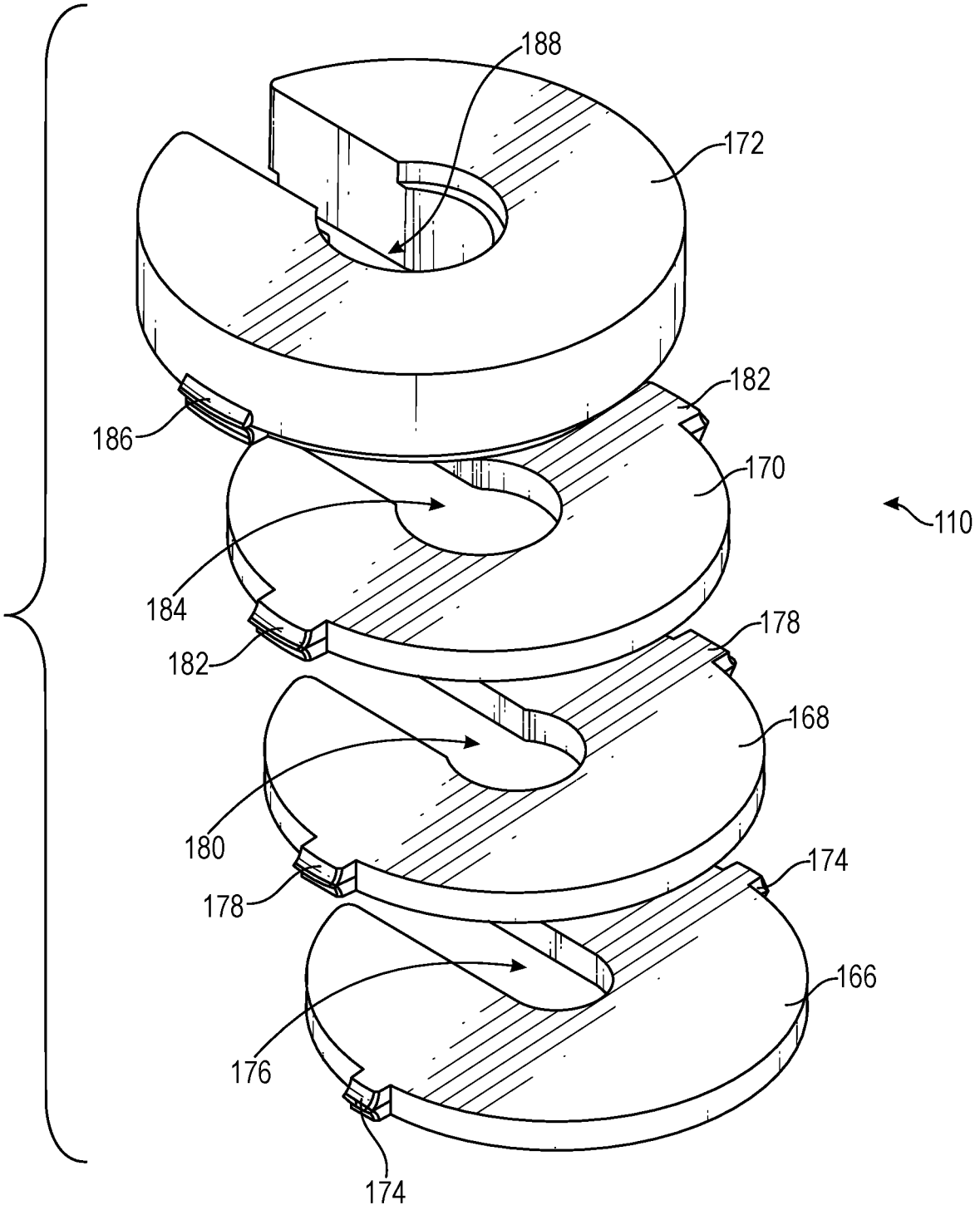
FIG. 9 illustrates a top perspective view of a plurality of removable weighted discs of a golf swing training apparatus.

As shown in FIGS. 8-9, after the top cap 106 is in an open position (i.e., spring 150 compressed, cap 106 twisted so that pin 148 is secured in the horizontal portion of L-shaped grooves 144, 146), the plurality of removable weighted discs 110 can be inserted into the housing 104 so that a golfer can change the weight of the golf apparatus 100 to their desired training weight. The plurality of removable weighted discs 110 may comprise a first disc 166, a second disc 168, a third disc 170, and a fourth disc 172, which can each be individually inserted into the housing 104. While four discs are shown, it will be appreciated that any number of weighted discs may be used. The plurality of removable weighted discs 110 may be color coded to assist a golfer in selecting the correct weight. For example, the first disc 166 may be red, the second disc 168 may be yellow, the third disc 170 may be blue, and the fourth disc 172 may be black. The plurality of removable weighted discs 110 may be of different thicknesses and weights or may be all the same weight. They may also be identified by some other identifying method other than color, such as an engraved or printed number.

Further, the plurality of weighted discs 110 are positioned around the housing shaft 122 and received within the housing 104. The first disc 166 comprises a first set of disc protrusions 174 and a first shaft slot 176 extending to the center thereof. The first disc 166 may be placed in the housing 104 with the first shaft slot 176 receiving the housing shaft 122. The first disc 166 is positioned between the first and second walls of the housing 124, 126, with the first set of disc protrusions 174 resting in the first and second tiered disc protrusion channels 118, 120. It will be understood that other methods of adding varying weighted discs can be utilized and is not limited to being placed within the housing 104 or around the housing shaft 122.

The second disc 168 comprises a second set of disc protrusions 178 and a second shaft slot 180 extending to the center thereof, wherein the second set of disc protrusions 178 are wider than the first set of disc protrusions 174. Furthermore, the second shaft slot 180 at the center of the second disc 168 comprises a larger diameter so as to receive the tiered protrusion 160 on the bottom surface 154 of the top cap 106. The second disc 168 may be placed in the housing 104 with the second shaft slot 180 receiving the housing shaft 122. The second disc 168 is positioned between the first and second walls 124, 126 of the housing 104 and on the top of the first disc 168, with the second set of disc protrusions 178 resting in the first and second tiered disc protrusion channels 118, 120.

The third disc 170 comprises a third set of disc protrusions 182 and a third shaft slot 184 extending to the center thereof, wherein the third set of disc protrusions 182 are wider than the second set of disc protrusions 178. Furthermore, the third shaft slot 184 at the center of the third disc 170 comprises a larger diameter than the second disc 168 so as to receive the tiered protrusion 160 on the bottom surface 154 of the top cap 106. The third disc 170 may be placed in the housing 104 with the third shaft slot 184 receiving the housing shaft 122. The third disc 170 is positioned between the first and second walls 124, 126 of the housing 104 and on the top of the second disc 168, with the third set of disc protrusions 182 resting in the first and second tiered disc protrusion channels 118, 120.

The fourth disc 172 comprises a fourth set of disc protrusions 186 and a fourth shaft slot 188 extending to the center thereof, wherein the fourth set of disc protrusions 186 are wider than the third set of disc protrusions 182. Furthermore, the fourth shaft slot 188 at the center of the fourth disc 172 comprises a larger circular diameter that is recessed so as to receive the tiered protrusion 160 on the bottom surface 154 of the top cap 106. The fourth disc 172 may be placed with the fourth shaft slot 188 receiving the housing shaft 122. The fourth disc 172 is positioned between the first and second walls 124, 126 and on the top of the third disc 170, with the fourth set of disc protrusions 186 resting in the first and second tiered disc protrusion channels 118, 120. The fourth disc 172 has more depth and is heavier in weight than the first, second, and third discs, individually. Further, the fourth disc 172 may have a recessed edge in order to be positioned in the housing 104 that is narrower than the fourth disc 172. It will be appreciated that the disc protrusions assist a golfer in placing and removing the plurality of removable weighted discs 110. It will further be appreciated that in an alternate embodiment, the plurality of removable weighted discs 110 may not have a plurality of disc protrusions.

With the weighted discs in position, the top cap 106 may be twisted to release the pin 148 from the horizontal portions of the grooves 144, 146, allowing the spring 150 to extend and put pressure on the weighted discs 110, thereby securing them within the first and second walls 124, 126, thereby preventing unintended withdrawal while the golf apparatus 100 is in use. Further, it will be appreciated that the spring 150 and top cap 106 may extend to the bottom weight 166, should a user not desire to use all the weights provided. Accordingly, a user may use one or more weights 110 (e.g., 166, 168, 170, 172) individually or in combination.

The plurality of removable weighted discs 110 allow a golfer, whether child, woman, man, or senior, to practice with a single golf club at a variety of weights. It will be appreciated that a golfer will only need one club to perform all golf swing training, from swinging a lighter club to get the feel of a faster head speed, to swinging a club with all the weights that is heavier than a normal golf club to improve club swing speed. In addition, there is the option to add significantly more weight to stretch out muscles before practicing or playing. In contrast, the prior art lacks adjustability to change weight in a single club. Specifically, to practice with every weight necessary, and for each age and gender, a golfer would have to purchase numerous clubs. This can become very expensive for a golfer. Not only can purchasing numerous clubs be a burden, or perhaps even cost prohibitive, but carrying those clubs is also a burden. Further, having to remember and carry numerous clubs may prevent a golfer from ever using the training clubs or using them properly.

Additionally, it will be appreciated that the housing 104, with all of its components (including weighted discs 110), may be sold separate from the club shaft 102 so that a golfer only needs to purchase the housing 104. This may allow golfers with extra clubs, or a desired shaft, to purchase the housing 104 and install it (e.g., bonding it to the shaft 122), which can keep costs down for the golfer.

Figure 10:
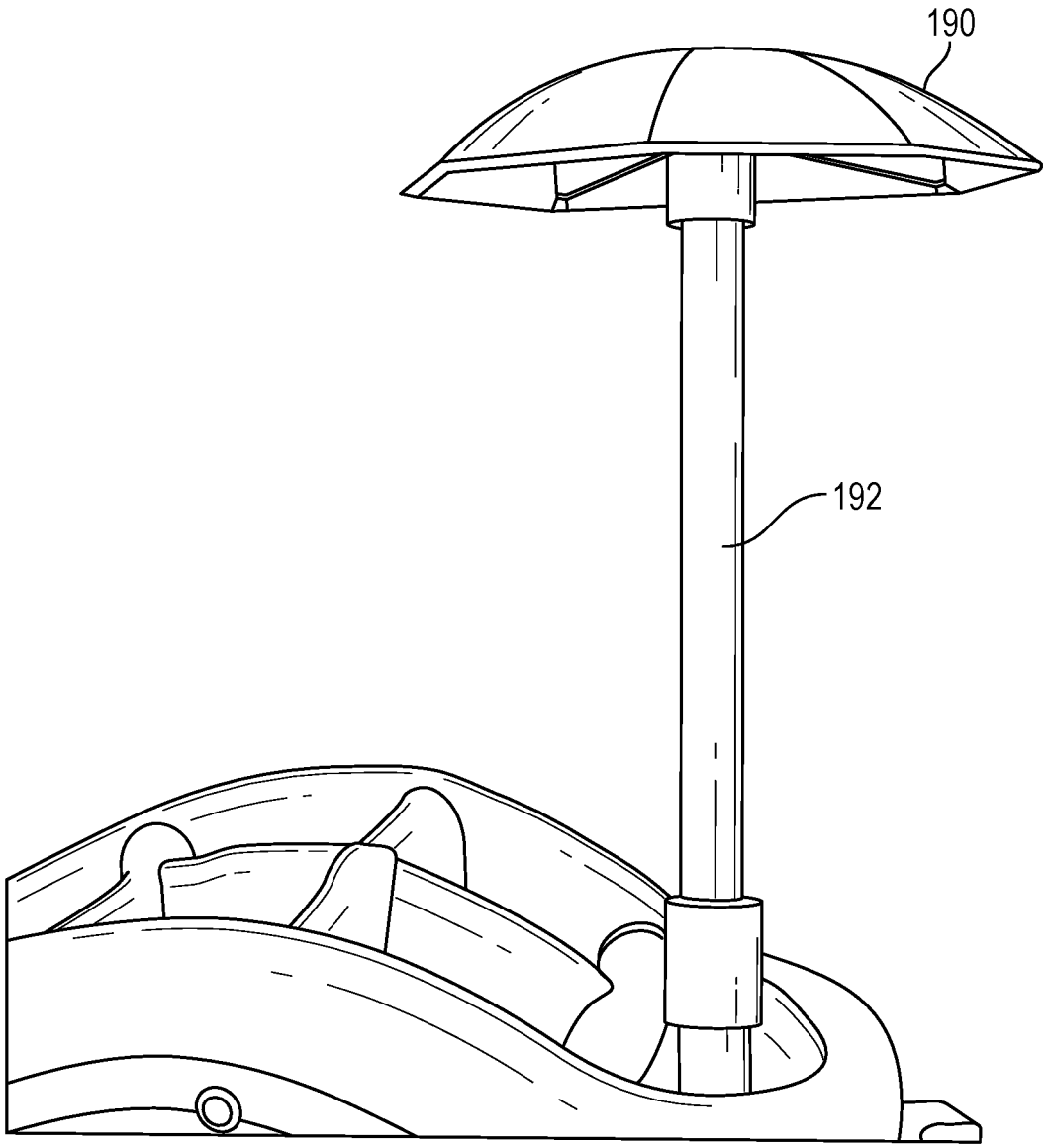
FIG. 10 illustrates a side perspective view of a club cap of a golf swing training apparatus.
Figure 11:
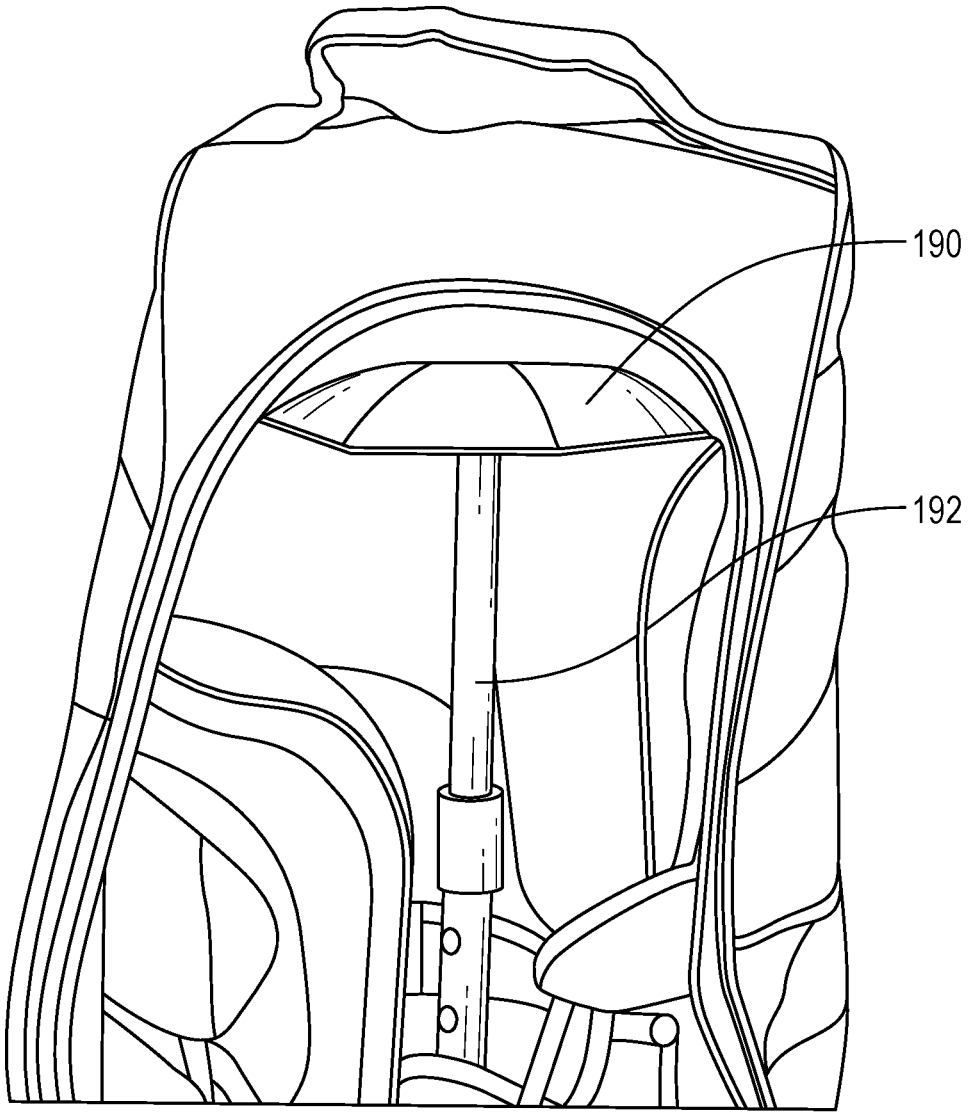
FIG. 11 illustrates a top perspective view of a club cap of a golf swing training apparatus.
Figure 12:
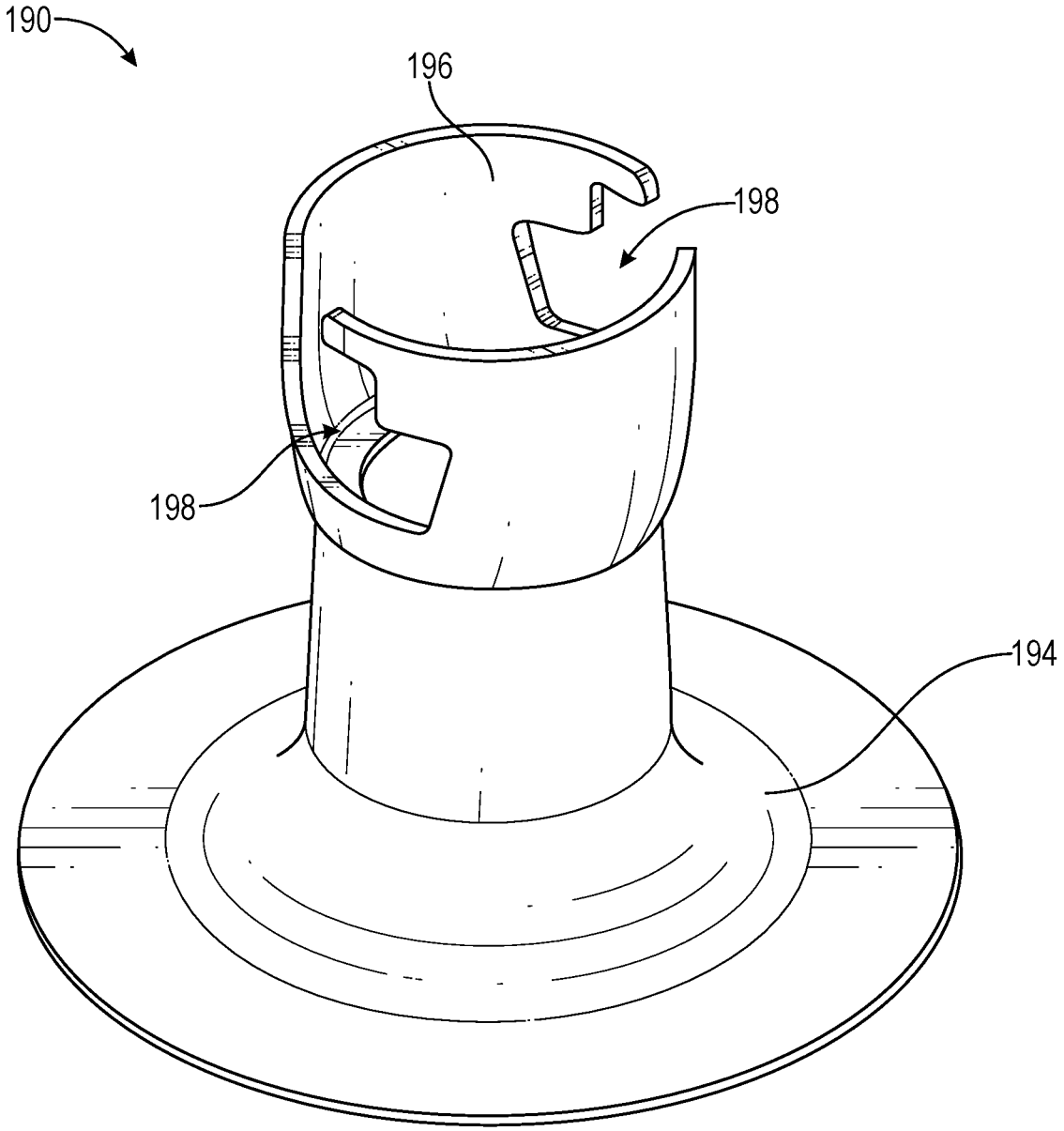
FIG. 12 illustrates a top perspective view of a club cap of a golf swing training apparatus.
Figure 13:
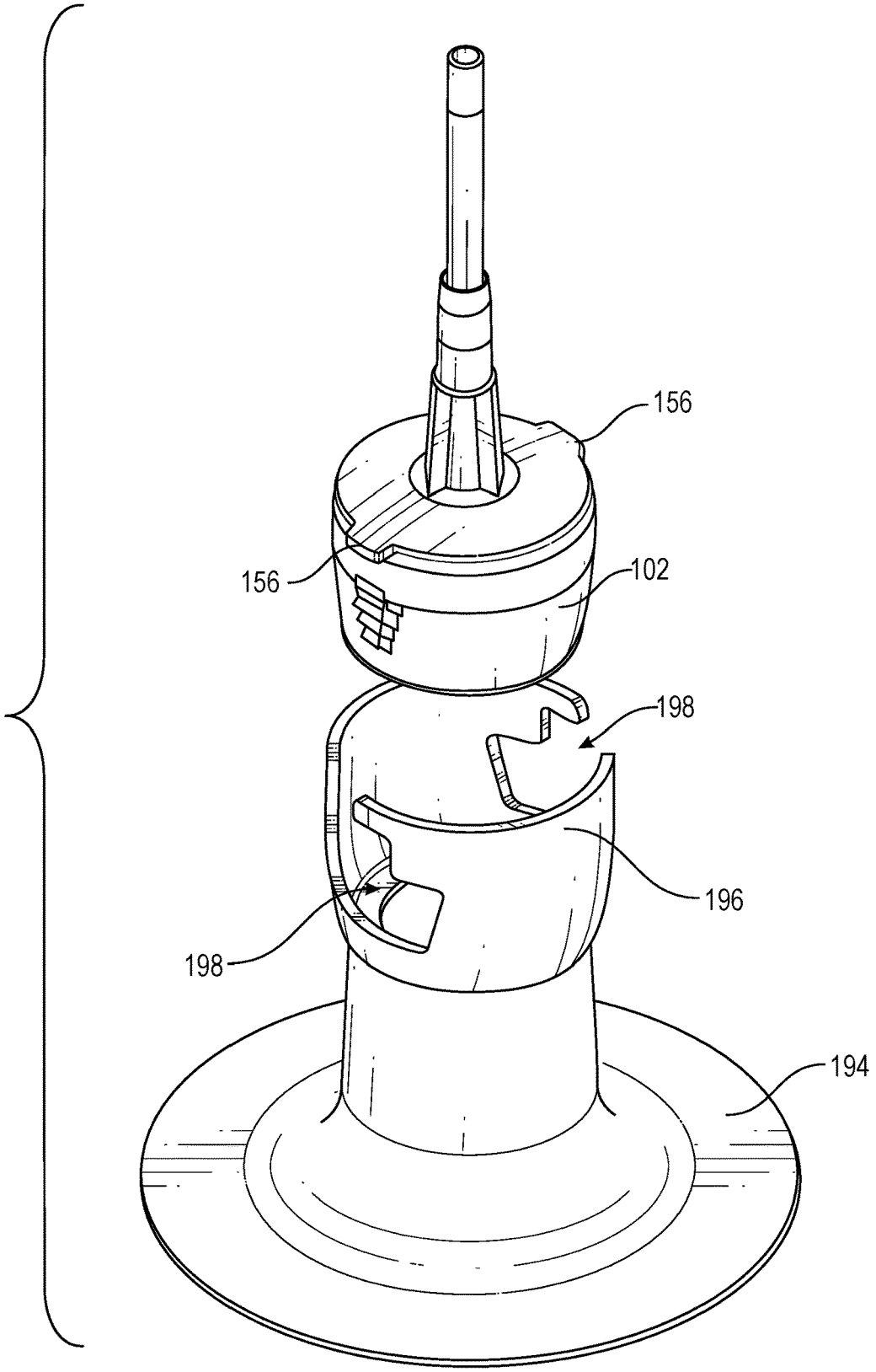
FIG. 13 illustrates a top perspective view of a club cap and a housing of a golf swing training apparatus, uncoupled.
Figure 14:
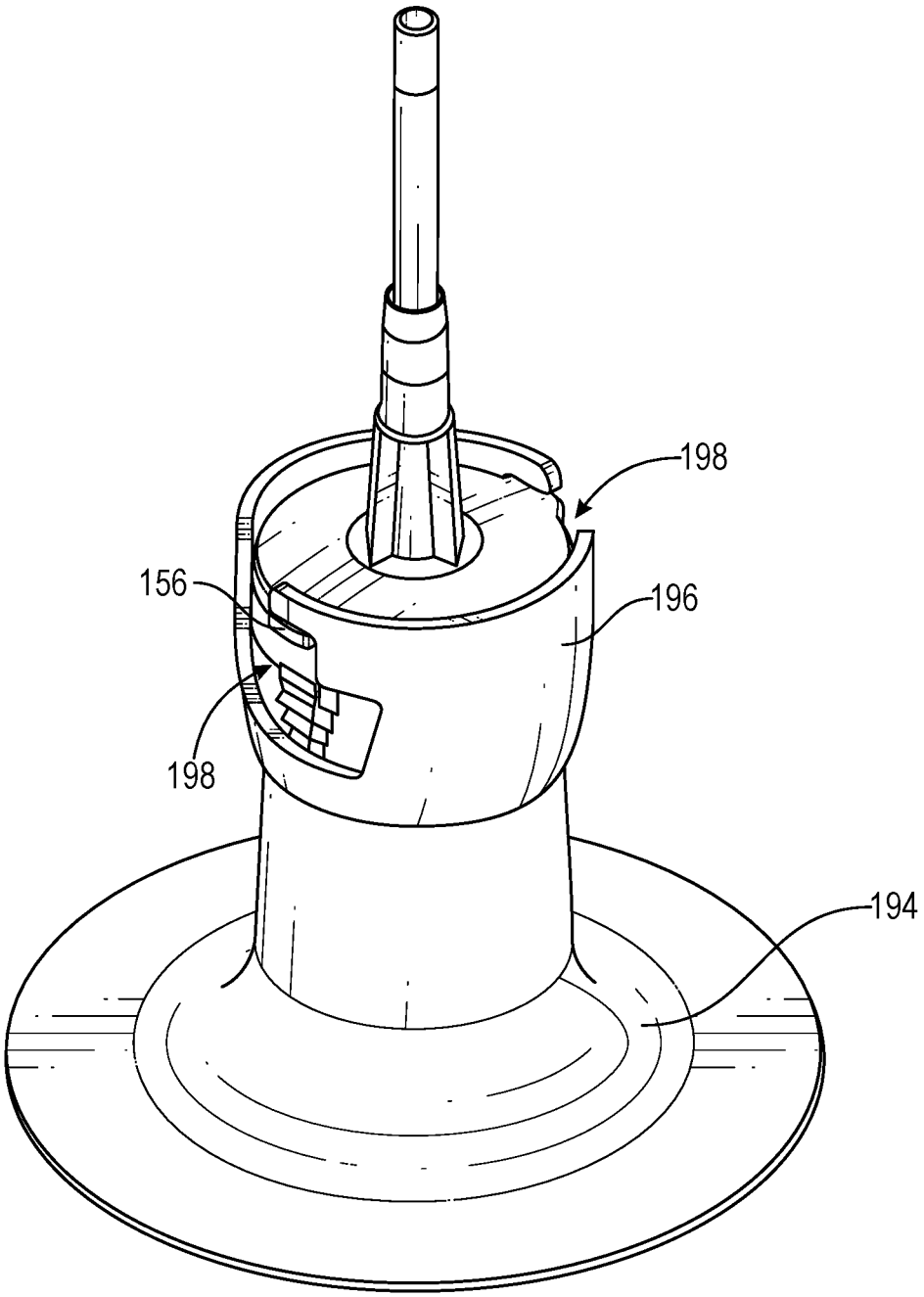
FIG. 14 illustrates a perspective view of a club cap coupled to a housing of a golf swing training apparatus, coupled.

In one embodiment, a golf apparatus 100, shown in FIGS. 10-11, comprises a club cap 190. The club cap 190 with a club cap shaft 192 may couple to the top portion 112 of the handle 116, or to the housing 102, of the golf apparatus 100 through, for example, a slide on securing mechanism or any other mechanism. In an alternate embodiment, shown in FIGS. 12-14, the club cap 190 comprises a cap portion 194, a housing receiving portion 196, and finger protrusion locking apertures 198. For example, to couple the club cap 190 to the golf apparatus 100, the housing 102 may be positioned in the housing receiving portion 196, with the pair of finger protrusions 156 positioned in the finger protrusion locking apertures 198. A user then can twist the club cap 190, locking the club cap 190 in place. The club cap 190 may be flat, dome shaped, or any other shape, to offer protection to other shafts. It will be appreciated that the club cap 190 may protect the other clubs in the bag during travel and shipping of the golf clubs. The club cap 190 can act as a golf apparatus 100 identifier due to the fact that the club cap 190 makes the golf apparatus 100 longer than all the other clubs in the bag. Further, the attachment to make the club longer may be placed on the handle end of the club instead, providing the same benefit of making it the longest club in the bag, and thus protecting all of the other clubs during travel.

Figure 15:
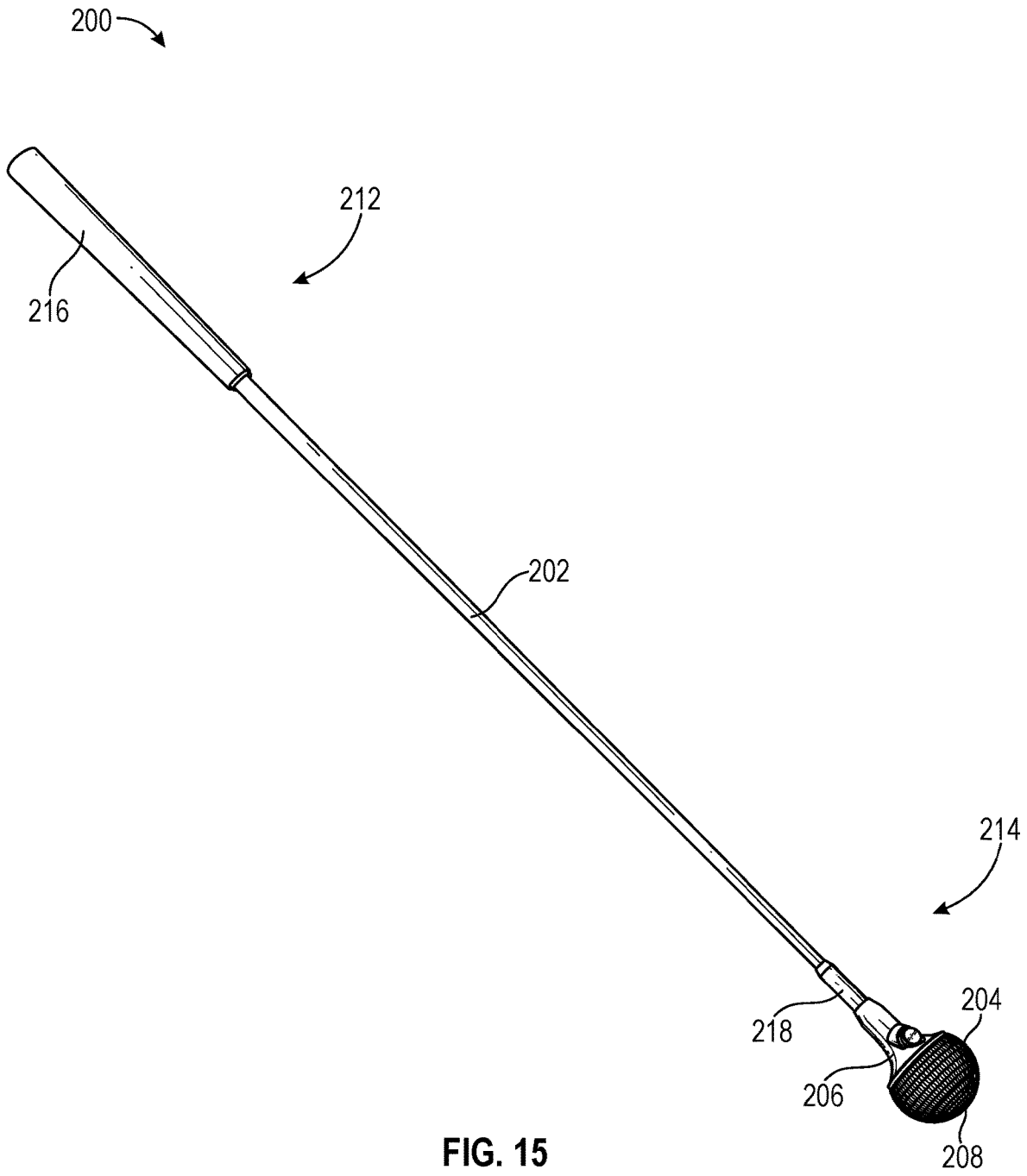
FIG. 15 illustrates a side perspective view of a golf swing training apparatus.
Figure 16:
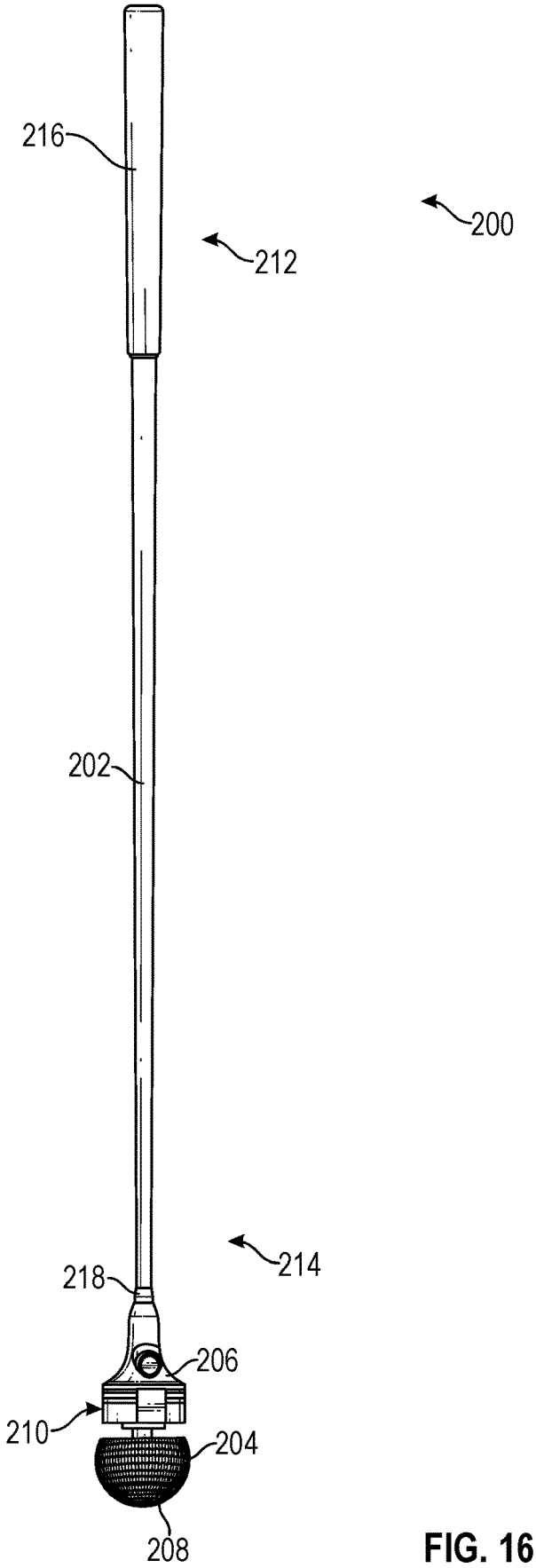
FIG. 16 illustrates a side elevation view of a golf swing training apparatus.
Figure 17:
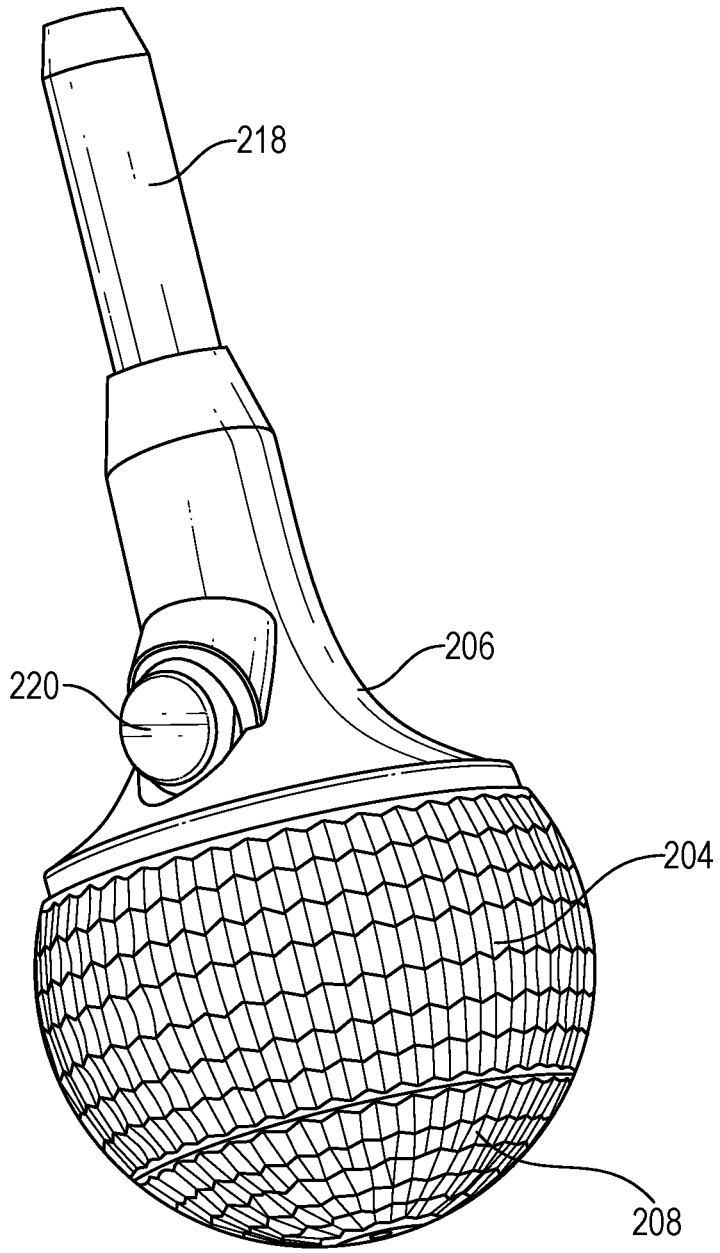
FIG. 17 illustrates a detailed, side perspective view of a top cap, housing, and a bottom cap of a golf swing training apparatus in a closed configuration.
Figure 18:
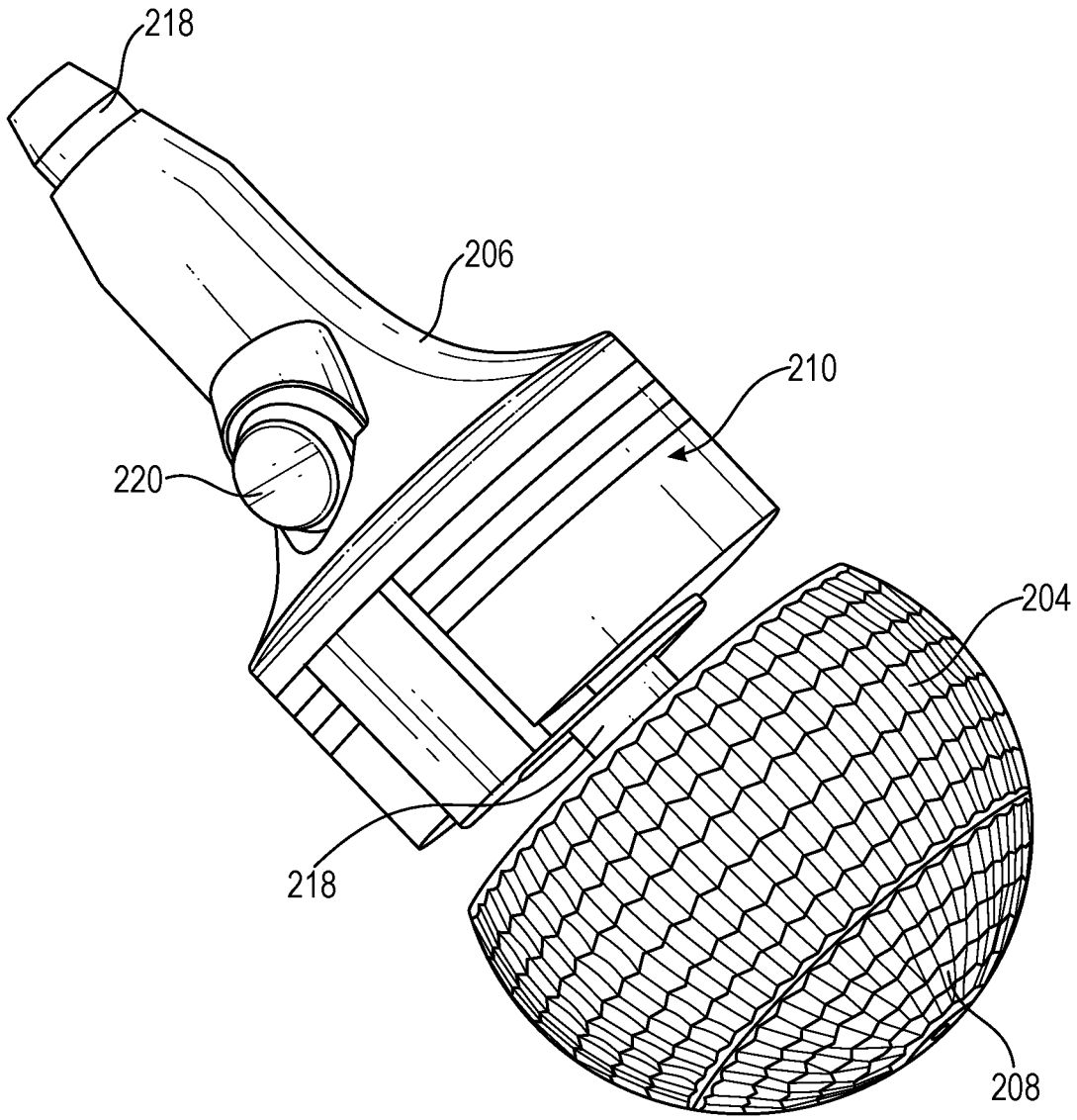
FIG. 18 illustrates a detailed, side perspective view of a top cap, a housing, and a bottom cap of a golf swing training apparatus in an open configuration.

In one embodiment, as shown in FIGS. 15-16, in one embodiment, a golf apparatus 200 comprises a club shaft 202, a housing 204 with a top cap 206 and a bottom cap 208 coupleable thereto, and a plurality of removable weighted discs 210. The club shaft 202 comprises a top portion 212 and a bottom portion 214, wherein the top portion 212 includes a handle 216 and the bottom portion 214 comprises the housing 204 with the bottom cap 208 and the top cap 206, and the plurality of removable weighted discs 210, which may be positioned in the housing 204.

The club shaft 202 may be of varying lengths, such as a short shaft for a child's club or a longer shaft for an adult golf club. The club shaft 202 may be stainless steel; however, other materials may be used, such as graphite, chrome-plated steel, titanium, carbon fiber, etc. The top portion 212 of the club shaft 202 comprises the handle 216, which may be made of a rubber, synthetic rubber, leather, or other material known in the art. Further, the bottom portion 214 of the club shaft 202 comprises the housing 204 with the top cap 206 and the bottom cap 208, and a plurality of removable weighted discs 210 that allow a user to adjust the weight of the golf apparatus 200.

Figure 19:
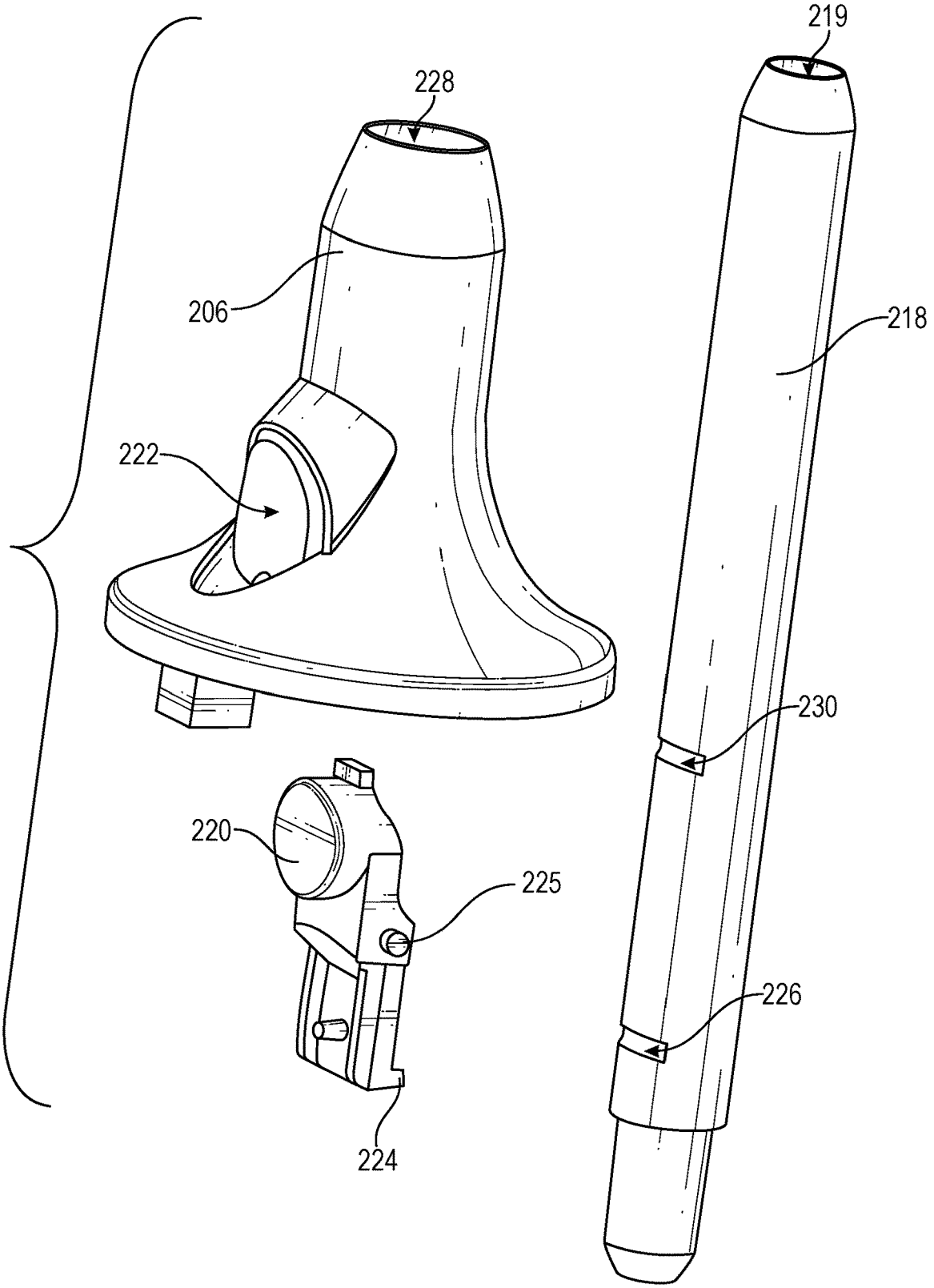
FIG. 19 illustrates a perspective exploded view of a top cap, a push-button lock, and a housing shaft of a golf swing training apparatus.

As shown in FIGS. 17-20, the housing 204 may be circular in shape, oval, or any other shape or formfactor. The housing 204 may be made of aluminum, plastic, carbon fiber, steel, or a combination of materials. The housing 204 may couple to a housing shaft 218 in the center thereof, which the housing shaft 218 may couple to the club shaft 202 via a shaft aperture 219 (FIG. 19). To open the housing 204, the top cap 206 comprises a push-button lock 220. While the push-button lock 220 is shown, it will be understood that a lever or any other locking mechanism may be used. Once the push-button lock 220 is depressed, the top cap 206 may slide up, towards the handle 216 on the housing shaft 218, thereby exposing and allowing access to the plurality of removable weighted discs 210. More specifically, as the push-button lock 220 is depressed into a lock aperture 222 positioned on the top cap 206, a button protrusion 224 pivots on pivot point 225 and is decoupled from a lower slot 226, allowing the top cap 206 to slide upwardly towards the handle 216 on the housing shaft 218 via a top cap aperture 228. When a user desires to secure the housing 204 in an opened position, the user may slide the top cap 206 until the button protrusion 224 is positioned in an upper slot 230. It will be appreciated that the lower and upper slots 226, 230 allow the top cap 106 to be secured in a closed or open position, respectively.

Figure 20:
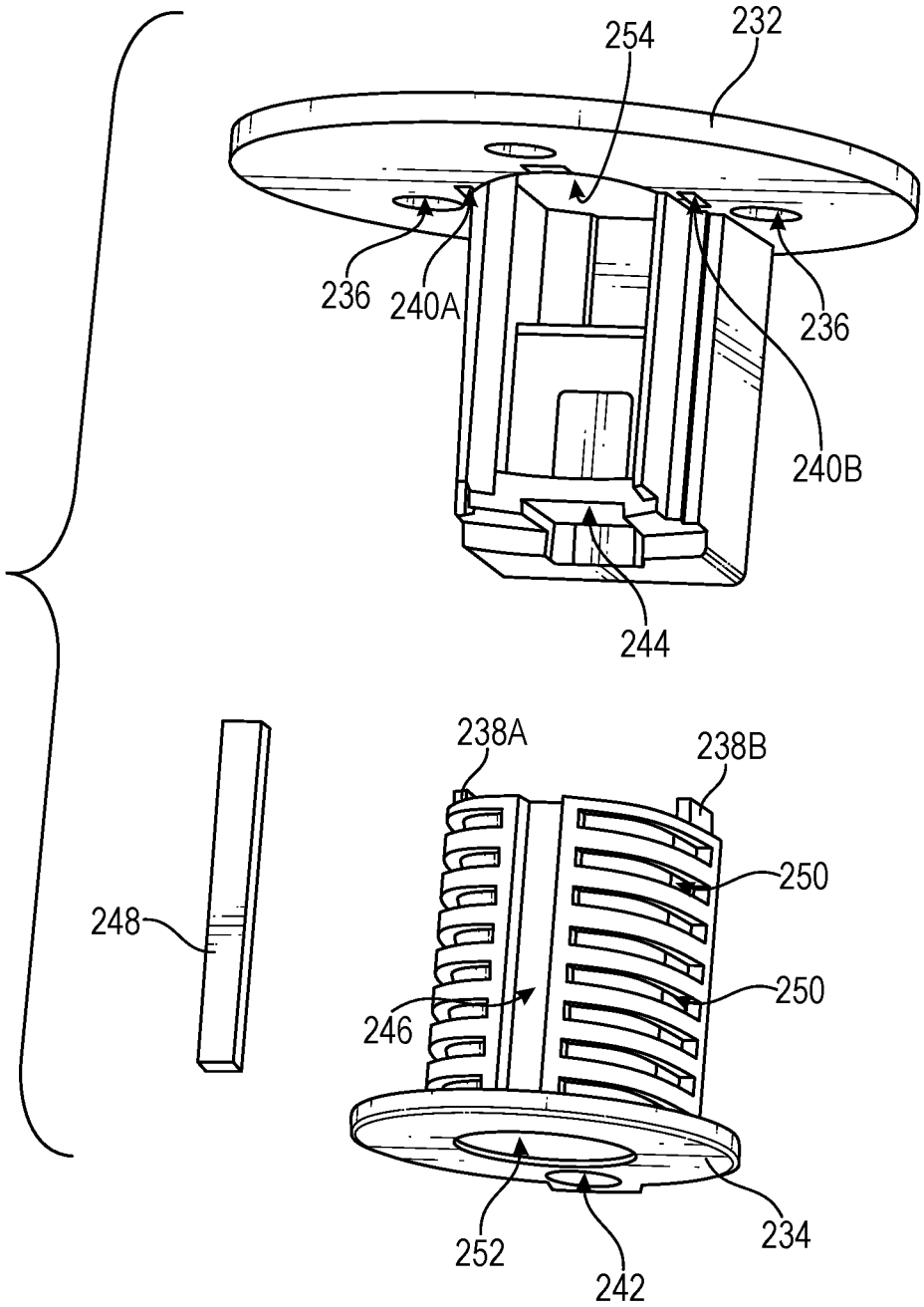
FIG. 20 illustrates a bottom, side exploded perspective view of a first receiver and a second receiver of a golf swing training apparatus.

Furthermore, referring to FIG. 20, the top cap 206 may comprise a first disc receiver 232 and a second disc receiver 234. The first disc receiver 232 may couple to the top cap 206 via screws or other types of securement mechanisms. The screws may be inserted through first receiver apertures 236 and into the top cap 206. As the first disc receiver 232 is directly coupled to the top cap 206, the second disc receiver 234 may be coupled to the first disc receiver 234. For instance, the second disc receiver 234 may comprise a first and a second protrusion 238A, 238B that may be placed in protrusion apertures 240A, 240B on the first disc receiver 232. Further, a screw or other securement mechanism may be placed through a second receiver aperture 242 on the second disc receiver 234 and into a coupling aperture 244 on the first receiver 232, thereby securing the second disc receiver 234 to the first disc receiver 232. The second disc receiver 234 may further comprise a channel 246 to receive a coupler 248, such as a magnet. The coupler 248 helps guide and secure the plurality of removable discs 210 into their proper positions on disc slots 250 located on the second disc receiver 234. It will be appreciated that the first disc receiver 232 comprises a first shaft aperture 252, and the second disc receiver 234 comprises a second disc aperture 254 so as to allow the first and second disc receiver 232, 234 to move up and down the housing shaft 218.

Figure 21:
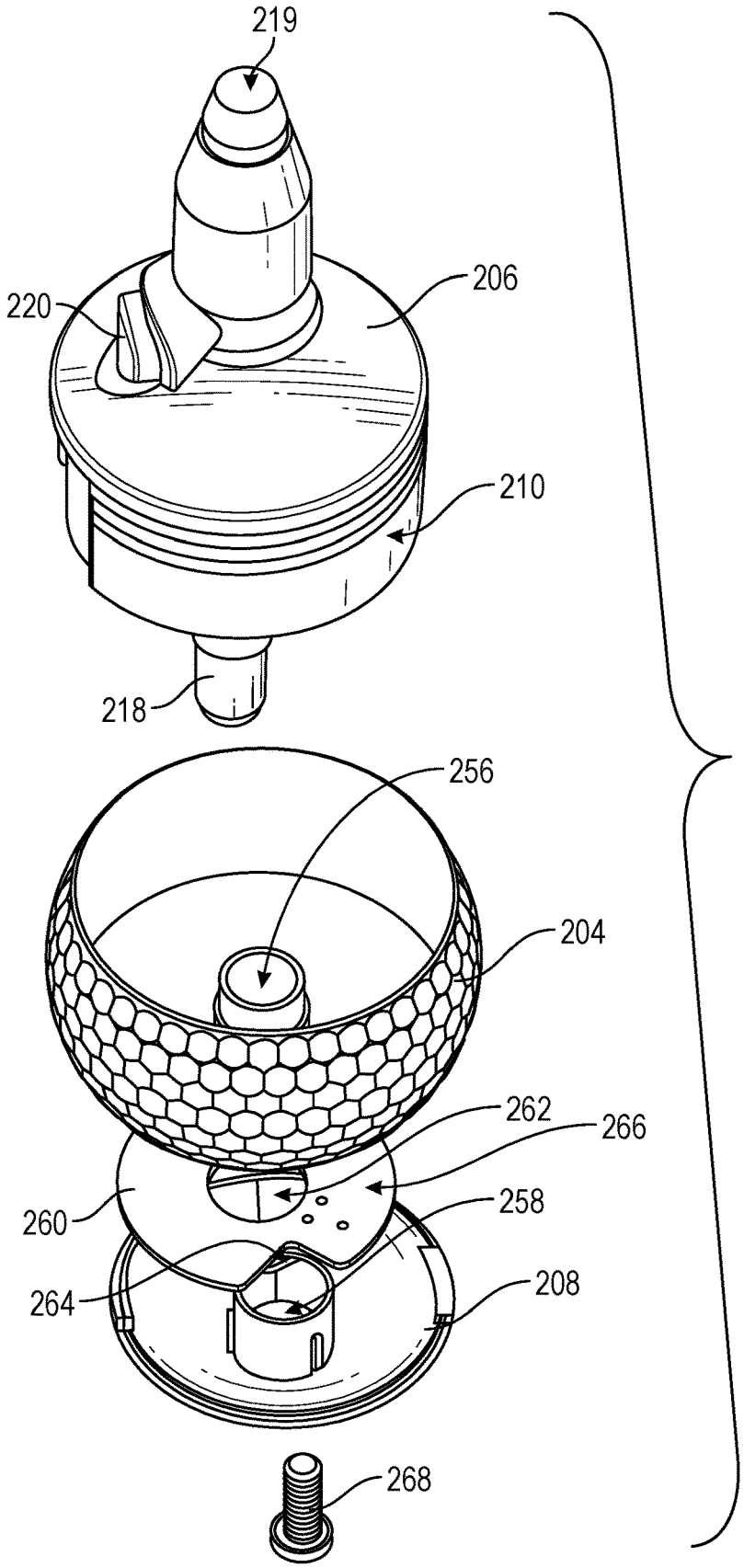
FIG. 21 illustrates a top, side exploded perspective view of a top cap, housing, and a bottom cap of a golf swing training apparatus.
Figure 22:
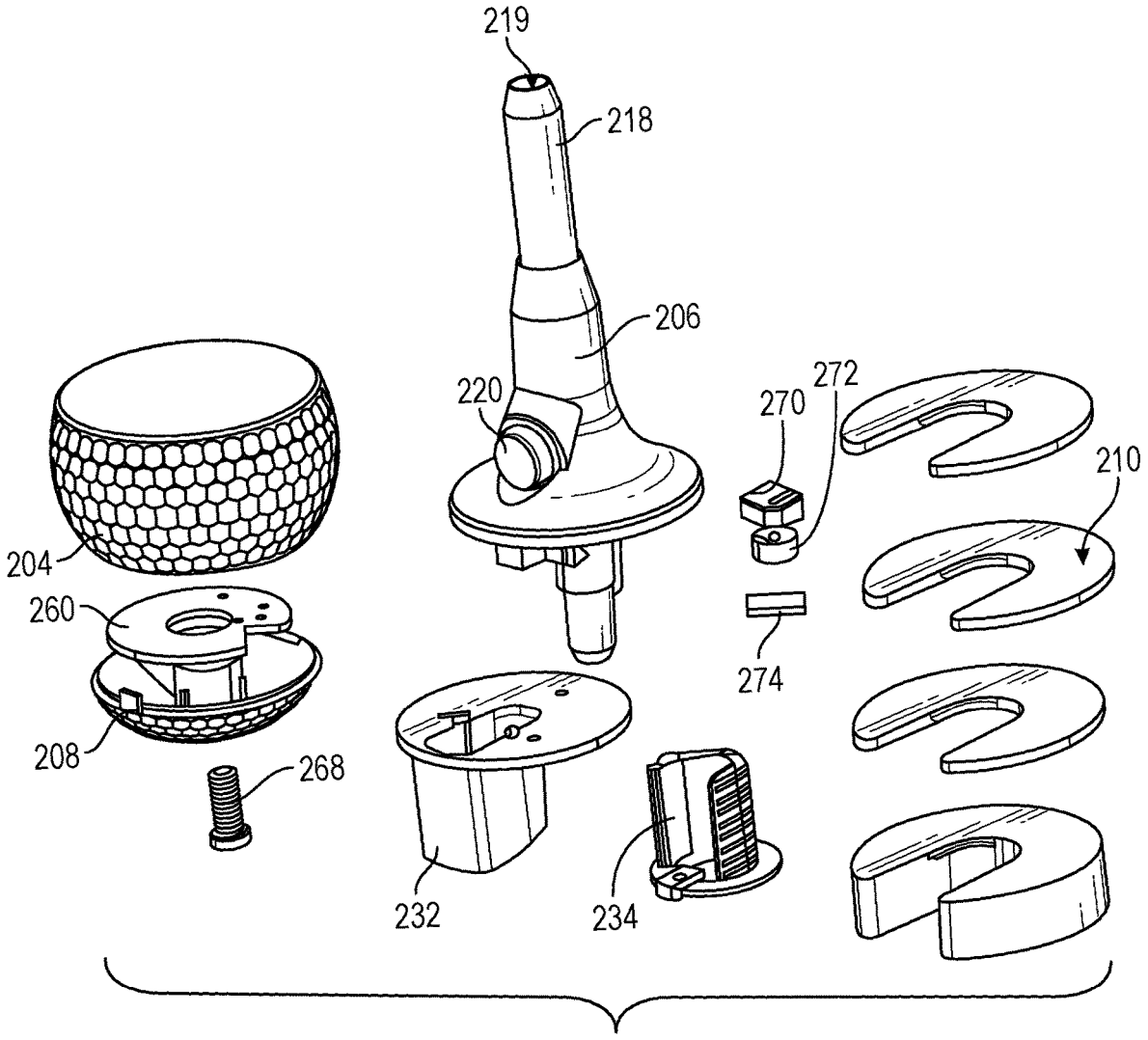
FIG. 22 illustrates a side exploded view of a golf swing training apparatus.

Further, as shown in FIG. 21-22, the bottom cap 208 may couple to the housing 204. Both the housing 204 and the bottom cap 208 may receive the housing shaft 218 via a housing aperture 256 and a bottom aperture 258. While the bottom cap 208 is a separate part of the housing 204, it will be appreciated that the bottom cap 208 may, in some embodiments, be a permanent part of the housing 204. Interposed between the housing 204 and the bottom cap 208 is a component ring 260. Similar to the bottom cap 208 and the housing 204, the component ring 260 comprises a component aperture 262 to receive the housing shaft 218. The component ring 260 may further comprise a cutout portion 264 and apertures 266 to receive various components, which are positioned between the housing 204 and the bottom cap 208. To couple the bottom cap 208, the component ring 260, and the housing 204 to the housing shaft 218, a user may insert a screw 268 or any other securement mechanism through the bottom aperture 258, thereby securing the bottom cap 208.

Prior to securing the bottom cap 208, components, which were briefly mentioned above, may be coupled to the component ring 260. For example, the components may comprise a battery holder 270, a battery 272, and an accelerometer 274, which may be placed on or coupled to the component ring 260. The component ring 260 may also be, or comprise, a printed circuit board. Additional components may also be included, such as a wireless transmitter or transceiver to transmit data from the accelerometer. A microcontroller or other processor may also be provided, or, in the alternative, a user's phone or other smart device can be used to process the data received from the accelerometer and display the data to the user. The above described components are collectively referred to herein as "smart components." It will be appreciated that, in some embodiments, the golf apparatus 200 does not require the smart components. Alternatively, in one embodiment, the smart components may be externally coupled to the golf apparatus 200 or any other standard golf club via, for example, clips, straps, screws, etc. In other words, a user could couple the accelerometer (and associated components) to a third-party golf club using straps so as to receive data about the swing speed, acceleration, etc. of the golf club. In other words, the accelerometer and associated components can be a separate device from the housing disclosed herein, which allows the user to use the accelerometer functions on the training club disclosed herein or on third-party golf clubs. It will be appreciated that the accelerometer 274 allows a golfer to measure swing speed, acceleration, path of the club head during a full swing, and measure club head alignment and position in various geometric planes, which allows the golfer to understand the mechanics of their swing and where adjustments can be made. Other sensors may also be utilized, such as a sensor on the golf club shaft that is capable of measuring bending/flexing along with other desirable data.

Figure 23:
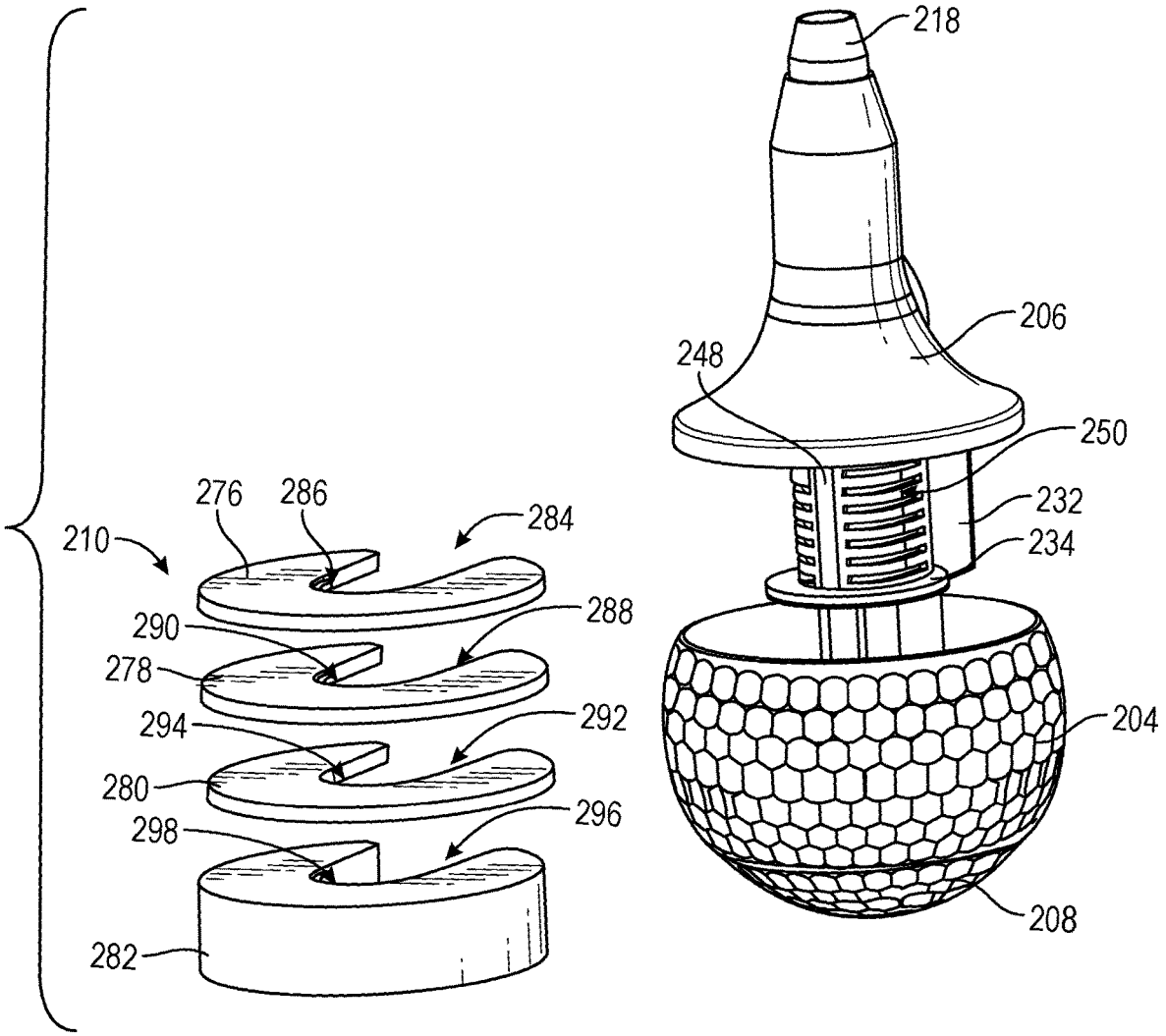
FIG. 23 illustrates a side perspective view of a golf swing training apparatus with a plurality of removable weighted discs removed therefrom.
Figure 24:
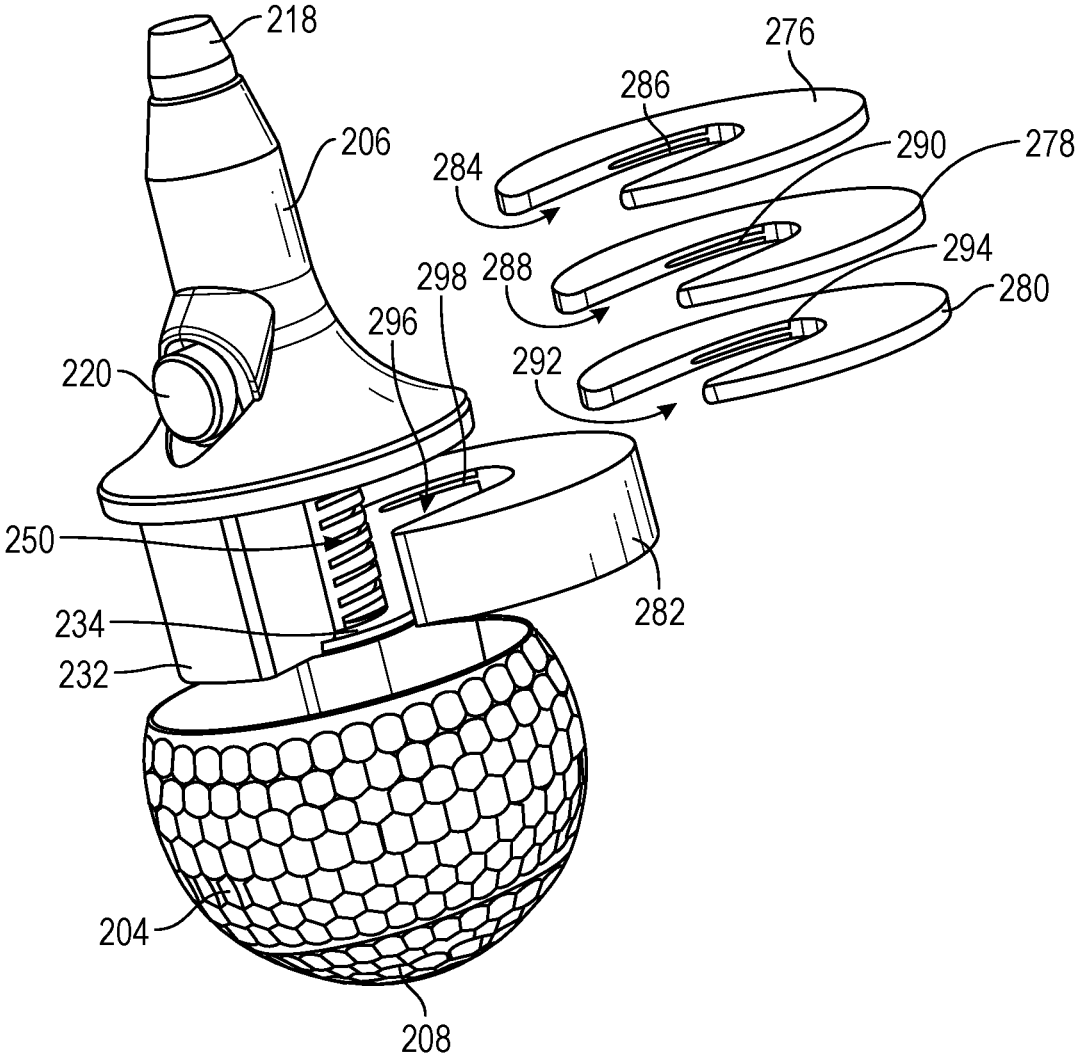
FIG. 24 illustrates a side perspective view of a golf swing training apparatus with a fourth disc being positioned thereon.

As shown in FIGS. 23-24, after the top cap 206 is in an open position, the plurality of removable weighted discs 210 can be inserted into the housing 204 so that a golfer can change the weight of the golf apparatus 200 to their desired training weight. The plurality of removable weighted discs 210 may comprise a first disc 276, a second disc 278, a third disc 280, and a fourth disc 282, which can each be individually inserted into the housing 204. While four discs are shown, it will be appreciated that any number of weighted discs may be used. In other words, a golfer may place one or more of the discs into the housing 204 to achieve the desired weight. Further, the plurality of weighted discs 210 may vary in weight depending on the end user. For example, the plurality of weighted discs 210 may be lighter in weight for a junior club. The plurality of removable weighted discs 210 may be color coded to assist a golfer in selecting the correct weight. The plurality of weighted discs may also be identified by some other identifying method other than color, such as an engraved or printed number. The plurality of removable weighted discs 210 may be of different thicknesses and weights or may be all the same thickness and weight. Further, the plurality of weighted discs 210 may be manufactured of a ferromagnetic material, such as iron, so as to be coupled to the coupler 248 (e.g., a magnet). In one embodiment, the weighted discs 210 may be manufactured from any suitable material and may have a strip of metal or other magnetic material adhered to the inner portion of the slot protrusions (discussed more below) for coupling to the coupler 248.

The plurality of weighted discs 210 are positioned around the first and second disc receivers 232, 234 and received within the housing 204. In particular, the first disc 276 comprises a first slot 284 extending to the center thereof. The first disc 276 further comprises first slot protrusions 286 positioned in the first slot 284. Accordingly, the first disc 276 may be placed in the housing 204 with the first slot protrusions 286 positioned in the disc slots 250, and the coupler 248 may guide and secure the first disc 276. It will be understood that other methods of adding varying weighted discs can be utilized and is not limited to being placed within the housing 204. The second disc 278 comprises a second slot 288 extending to the center thereof. The second disc 278 further comprises second slot protrusions 290 positioned in the second slot 288. The second disc 278 may be placed in the housing 204 with the second slot protrusions 290 positioned in another set of disc slots 250, and the coupler 248 may guide and secure the second disc 278.

The third disc 280 comprises a third slot 292 extending to the center thereof. The third disc 280 further comprises third slot protrusions 294 positioned in the third slot 292. The third disc 280 may be placed in the housing 204 with the third slot protrusions 294 positioned in another set of disc slots 250, and the coupler 248 may guide and secure the second disc 280. The fourth disc 282 comprises a fourth slot 296 extending to the center thereof. The fourth disc 282 further comprises fourth slot protrusions 298 positioned in the fourth slot 296. The fourth disc 282 may be placed in the housing 204 with the fourth slot protrusions 298 positioned in the disc slots 250, and the coupler 248 may guide and secure the fourth disc 282. The fourth disc 282 has more depth and is heavier in weight than the first, second, and third discs 276, 278, 280, individually.

Once the desired weighted discs 210 have been added, the user may depress the push-button lock 220, releasing the button protrusion 224 from the upper slot 230, allowing the top cap to slide downward toward the housing 204, inserting the weighted discs 210 therein. The button protrusion then engages lower slot 226, securing the top cap 206 to the housing 204, securing the weighted discs 210 therein. It will be appreciated that springs may be utilized to aid the action of the push-button lock 220 or to aid in maintaining the top cap 206 in a closed position, as described in earlier embodiments. The plurality of disc slots 250 ensure that the weighted discs 210, regardless of the number of discs inserted, remain in position when enclosed in the housing 204.

In one embodiment, a golf apparatus 100, 200 comprises a removably attachable accelerometer. The removably attachable accelerometer may be positioned on the housing, wherein the removably attachable accelerometer measures the speed, acceleration, and the path that the club head goes through as a golfer conducts an entire swing from start to finish. The removably attachable accelerometer includes components known in the art for functionality, including, but not limited to, a battery and means for transmitting data (e.g., radio transmitter/transceiver). It will be appreciated that by using an accelerometer, a golfer is able to know when maximum speed and/or acceleration is reached, along with measuring club head alignment and position in various geometric planes, allowing the golfer to adjust their swing. Also, the golfer does not have to purchase a separate swing speed measuring device or accelerometer. In the prior art, a golfer must determine whether there is improvement without the aid of a measurement device or must purchase a measuring device that is separate from their training clubs. In addition, the measurement device in the prior art is expensive and only measures the speed of the club head as it goes past the measurement device. In some embodiments, the removably attachable accelerometer may be coupled to existing golf clubs and be independent from the golf apparatus 100, 200. Accordingly, individuals may purchase the removably attachable accelerometer and place it on existing clubs, no matter the club type or size.

As mentioned, in one embodiment, a golf apparatus 100, 200 comprises a transmitter to connect to and transmit information to a smartphone or other device. The information may be transmitted via Bluetooth® or similar wireless technologies. The smartphone can process the signals from the accelerometer detailing not only the speed of each practice swing, but the swing speed at each phase of the swing, and the point of maximum acceleration. It can also measure the swing path and analyze it for swing improvement analysis. The smartphone may evaluate the progress of the golfer's swing speed through each swing. The smartphone can allow the golfer to visualize the data so that changes can be made to the golf swing, which may maximize swing efficiency. Further, the smartphone may keep track of the swing speeds and track progress over time. Accordingly, the golf apparatus 100, 200 disclosed herein solves many problems in the art.

It will also be appreciated that apparatus and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A golf swing training apparatus, comprising:

a housing with a top cap and a bottom cap;

a plurality of removable weighted discs positionable within the housing;

the top slidable to an open position, wherein when the top cap is in the opened position, the plurality of removable weighted discs are insertable into the housing; and wherein when the top cap is in a closed position, the plurality of removable weighted discs are secured within the housing;

wherein the top cap further comprises a push-button lock, wherein actuation of the push-button lock allows the top cap to slide to an open or closed position.

2. The golf swing training apparatus of claim 1, further comprising a housing shaft to receive the housing, top cap, and the bottom cap, the housing shaft coupleable to a club shaft.

3. The golf swing training apparatus of claim 1, wherein the top cap further comprises a disc receiver.

4. The golf swing training apparatus of claim 3, wherein the disc receiver comprises a plurality of disc slots to receive the plurality of removable weighted discs.

5. The golf swing training apparatus of claim 3, wherein the disc receiver comprises a magnetic coupler.

6. The golf swing training apparatus of claim 1, further comprising a component ring interposed between the bottom cap and the housing, the component ring comprising:

a battery holder, a battery, and an accelerometer.

7. The golf swing training apparatus of claim 1, wherein the plurality of removable weighted discs each have a distinct weight.

8. The golf swing training apparatus of claim 1, wherein the plurality of removable weighted discs each comprise a slot for receiving a disc receiver, the slot comprising slot protrusions for mating with disc slots on the disc receiver.

9. The golf swing training apparatus of claim 1, further comprising a spring for applying a force to the top cap, forcing the top cap toward the housing.

10. A golf swing training apparatus, comprising:

a housing shaft coupleable to a club shaft, the housing shaft receiving a housing, a top cap, and a bottom cap;

a plurality of removable weighted discs positionable within the housing;

a component ring interposed between the bottom cap and the housing, the component ring comprising:

a battery holder, a battery, and an accelerometer;

wherein the top cap further comprises a first disc receiver and a second disc receiver;

the top cap slidable on the housing shaft, wherein when the top cap is in an opened position, the plurality of removable weighted discs are positionable on the first and a second disc receivers.

11. The golf swing training apparatus of claim 10, wherein the top cap further comprises a push-button lock to secure the top cap in an open or closed position.

12. The golf swing training apparatus of claim 10, wherein the second disc receiver comprises a coupler to guide and receive the plurality of removable weighted discs.

13. The golf swing training apparatus of claim 12, wherein the coupler is a magnet.

14. The golf swing training apparatus of claim 10, wherein the second receiver comprises disc slots to guide and receive the plurality of removable weighted discs.

15. The golf swing training apparatus of claim 10, wherein the accelerometer transmits one or more of speed, acceleration, and swing path to a user device.

16. A method of using a golf swing training apparatus, the method comprising:

opening a housing coupled to a distal end of a club shaft;

inserting one or more weights into the housing until a desired weight is achieved; and closing the housing to secure the weights within the housing;

wherein a user actuates a push-button lock to open and close the housing.

17. The method of claim 16, further comprising receiving data from an accelerometer coupled to the housing and displaying the data on a user display.

18. The method of claim 17, wherein the data received is one or more of speed, acceleration, and swing path.

* * * * *